US006435763B1

(12) United States Patent
Sakane et al.

(10) Patent No.: US 6,435,763 B1
(45) Date of Patent: Aug. 20, 2002

(54) KEY HOLE INSERTION FOR MANHOLE AND MANHOLE COVER LOCKING APPARATUS EQUIPPED WITH THE KEY HOLE INSERTION AND MANHOLE COVER LOCKING SYSTEM AND UNLOCKING METHOD AND MANHOLE COVER OPENING AND CLOSING CONTROL SYSTEM

(75) Inventors: Tetsushi Sakane, Tokyo; Nakamaro Hyodo, Higashikurume; Takashi Fujii, Katano; Hironori Namioka, Osaka; Toshinari Kato, Choshi, all of (JP)

(73) Assignee: Haneda Humepipe Co., Ltd., Tokyo (JP)

( * ) Notice: Subject to any disclaimer, the term of this patent is extended or adjusted under 35 U.S.C. 154(b) by 0 days.

(21) Appl. No.: 09/537,259

(22) Filed: Mar. 29, 2000

(30) Foreign Application Priority Data

Apr. 27, 1999 (JP) ..... 11-119035
May 17, 1999 (JP) ..... 11-135382
Jun. 25, 1999 (JP) ..... 11-179499

(51) Int. Cl.[7] ..... E02D 29/14; B65D 55/02
(52) U.S. Cl. ..... 404/25; 70/169
(58) Field of Search ..... 404/25, 26; 52/19–21; 70/166–169, 171–173, 256–257, 278.1, 371

(56) References Cited

U.S. PATENT DOCUMENTS 4,914,732 A * 4/1990 Henderson et al. ..... 340/3.71
5,728,294 A * 3/1998 Deming ..... 404/25
6,081,199 A * 6/2000 Hogl ..... 70/278.1

* cited by examiner

*Primary Examiner*—William Neuder
*Assistant Examiner*—Sunil Singh
(74) *Attorney, Agent, or Firm*—Townsend & Banta

(57) ABSTRACT

The present invention is provided with a key hole insertion fitted to a manhole cover, a manhole cover locking apparatus equipped with the key hole insertion, a manhole cover locking system, a method for unlocking the manhole cover, and a control system for opening and a closing manhole cover, which is designed to prevent an external access to the key hole of the manhole cover, thus attaining a sound and severe locking management. The electrical locking assembly can be added to conventional manhole covers in a simple way. The structure of the invention is characterized in a key hole insertion A inserted in a key hole 3*b* of the inner manhole cover 3 or the key hole 5*b* of the manhole cover 5 enough to engage pins 11*b* with engaging openings 12*b* of the cap holding member 12 secured to the key hole 3*b* or the key hole 5*b*. This allows the key hole insertion A to be locked to the key hole 3*b* or the key hole 5*b*. It is also characterized in that the control chip 12 mounted in the inserting portion 9*a*, after receiving the unlock signal sent from external R/W terminal 18, transmits a control signal to pull the pins 11*b* inward enough to be released from the engaging opening 12*b*, and thus the access to the key hole 3*bb* or 5*b* is available.

16 Claims, 23 Drawing Sheets

| PERSON AUTHENTICATING CODE α | | MANHOLE COVER PLACEMENT CODE β | |
|---|---|---|---|
| TRADER NO. | PERSONAL CODE NO. | SECTION CODE NO. | SERIAL NO. |
| 450 | 6268 | 047 | 1960 |

FIG. 19

KEY HOLE INSERTION FOR MANHOLE AND MANHOLE COVER LOCKING APPARATUS EQUIPPED WITH THE KEY HOLE INSERTION AND MANHOLE COVER LOCKING SYSTEM AND UNLOCKING METHOD AND MANHOLE COVER OPENING AND CLOSING CONTROL SYSTEM

CROSS-REFERENCE TO RELATED APPLICATIONS

This application claims priority benefit under 35 U.S.C. 119(a–d) of Japanese Patent Application Heisei No. 11-119, 035, filed Apr. 27, 1999, of Japanese Patent Application Heisei No. 11-135,382, filed May 17, 1999 and of Japanese Patent Application Heisei No. 11-179, 499 filed Jun. 25, 1999, the contents of which are incorporated herein by reference herein.

BACKGROUND OF THE INVENTION

1. Field of the Invention

This invention relates to a key hole insertion of a manhole cover (including a handhole cover) formed at a manhole including a handhole, to a manhole cover locking apparatus equipped with the key hole insertion, to a manhole cover locking system, to a method for unlocking the manhole cover, and to a control system for opening and closing the manhole cover.

2. Description of Related Art

In recent years, according to highly developing road functions due to increase of property occupying roads and management incidental facilities such as a water supply and sewer systems, electric power systems, communications systems, and gas systems, and due to wide ranges of management information, collection of information and work on site where at work or the like becomes complicated, troublesome, and inefficient Therefore, constructions cannot be advanced without collecting and reading such information sources as maps or reports of each manager of property occupying roads.

To deal with this situation, road management systems utilizing a computer mapping have been promoted these days. With the system, each manhole cover has an IC chip storing the management data of roads, road management incidental facilities and property occupying roads; the field manager or field constructor can read the information related to the field management operation with a non-contact or contact reader. This technology has been proposed for realizing a better effectiveness of the rapid and accurate patrol, on site examination, construction, on-site meeting or the like.

Meanwhile, because the conventional locking apparatus for the manhole cover has relatively simple locking mechanism in which a tool is inserted from outside through a key hole formed in the manhole for locking or unlocking, an IC chip containing the management data of the management data of roads, road management incidental facilities or the property occupying roads is not sufficiently secured.

According to an prior art disclosed in Japanese Unexamined Patent Publication Heisei No.6-4199, a locking apparatus to prevent easily opening of manhole cover is described as shown in FIG. 22 (*a*), in which a rotatable locking portion 52 rotatably mounted to a cover body serving as a manhole cover engages with an engaging portion 54 of a supporting frame 53 to lock the manhole cover 51 and in which, to unlock the cover body 51 serving as a manhole cover, a tool, not shown, is inserted through an upper inserting opening 55 formed in the cover body 51 serving as a manhole cover and pushed downward enough to engage with a locking portion 52 through a lower inserting opening 56 of the locking portion 52 and thereafter pulled to release the locking portion 52 from the engaging portion 54 of the supporting frame 53.

Mounted detachably from the cover body 51 serving as a manhole cover in a holding seat 57 placed in the lower portion of the cover body 51 serving as a manhole cover is a locking body 58 shown in FIG. 22 (*b*) detachably from the cover body 51 serving as a manhole cover to prevent the insertion of the tool which is not shown. A lock base 59 having a head-shaped lock portion 59*a* is secured to the holding seat 57, and the locking body 58 is inserted through the upper inserting opening 55 of the cover body 51 serving as a manhole cover and mounted in such a manner that the lock portion 59*a* of the lock base 59 is contained inside an insertion chamber 58*a* formed on the bottom of the locking body 58. A key 60 is inserted in the locking body 58 and subsequently turned to engage the lock piece 58*b* formed at the locking body 58 with the lock portion 59*a* of the lock base 59, thereby locking the cover body 51 serving as a manhole cover with the locking body 58.

The locking body 58 has an openable and closeable key cover 58*c* on a top of the locking body 58, and the key cover 58*c* is fastened to the locking body 58 by a polygonal wrench or the like.

To open the cover body 51 serving as a manhole cover, the firmly fixed key cover 58*c* is to be loosed enough to open the key cover 58*c* to move its position from the upper insertion opening 55 to be on the cover body 51 serving as a manhole cover, and then the lock piece 58*b* is released from the lock portion 59*a* by inserting and turning the key 60 in the locking body 58, resulting in unlocking the locking body 58.

After the locking body 58 is removed from the upper insertion opening 55 of the cover body 51 serving as a manhole cover, a tool, not shown, is inserted through the upper insertion opening 55 of the cover body 51 serving as a manhole cover and forcibly pushed downward enough to engage with lower insertion opening 56 of the locking portion 52; pulling the tool causes the locking portion 52 to be released from the engaging portion 54 of the supporting frame 53, thus opening the cover body 51 serving as a manhole cover.

According to the structure above, when the cover is closed and in a locked position, the upper insertion opening 55 is filled with the key cover 58*c* of the locking body 58, and any tool or bar cannot be inserted unless the locking body 58 is removed. Because the key cover 58*c* conceals the key hole through which the key 60 is inserted into the locking body 58, and because the key cover 58*c* is firmly fastened by a polygonal wrench or the like to the locking body 58, the locking body 58 cannot be removed without special tools such as the polygonal wrench or the key 60, and therefore, it is preventable that the manhole cover is easily open.

The prior art above, however, raises problems that works are not easy due to increase of locking and unlocking steps because the key cover 58*c* for concealing the key hole is fastened by a polygonal wrench or the like to prevent the key 60 from becoming unable to be inserted due to grit in the key hole of the key cover 58 in which the key 60 is inserted.

It is also a problem that because the locking and unlocking states of each manhole cover cannot be managed in an integrated manner that the security of the manhole's inner facility might not be maintained when the operator leaves the site without unlocking or forgets locking the cover.

SUMMARY OF THE INVENTION

It is an object of the present invention to provide a key hole insertion for a manhole cover, a manhole cover locking apparatus equipped with the key hole insertion, a manhole cover locking system, an unlocking method, and a control system for opening and closing the manhole cover in which the key hole insertion rejectable an external access is detachably fitted to the key hole, in which a control chip mounted in the key hole insertion receives an unlocking command sent from outside, thus approving the opening and closing of the manhole cover, in which then a locking unit mounted in the key hole insertion, based on the command transmitted from the control chip, can unlock the key hole insertion from the key hole to lock the manhole cover surely and securely with the simple structure, in which only a person or group authorized to unlock can unlock, and in an electronic locking assembly can be easily added to the conventional locking apparatus of a conventional manhole cover with no electronic locking assembly.

It is another object of the present invention to provide an opening and closing control system of a manhole cover, in which a central control apparatus sends an unlock signal to the key hole insertion detachably fitted to the key hole formed in the manhole cover body and capable of rejecting an external access to integrally manage a locking or unlocking conditions of the manhole covers, and in which the system provides a simple structure, but achieves locking in a sure and strict way.

The key hole insertion according to the invention has a locking apparatus cap detachably fitted to the key hole mounted in the manhole cover for rejecting an external access through the key hole, a control chip mounted in the locking apparatus cap in which the control chip receives an unlock signal transmitted from outside to approve the opening of the manhole cover, a locking unit mounted in the locking apparatus cap for unlocking the locking apparatus cap from the key hole upon receiving a control command from the control chip.

According to the above structure, after a non-contact reading and writing terminal or the like is used for a personal identity confirmation (ID), an unlock signal is transmitted to the control chip from outside, and only when the control chip, receiving the unlock signal, allows the manhole cover to open or close, the locking unit can unlock the key hole insertion from the key hole of the manhole cover body, thus achieving a sure and strict locking of the manhole cover.

When the insertion is structured such that pins extendable radially outward with respect to an inserting portion of the locking apparatus cap to be inserted in the key hole in the cover body can be engaged with an engaging portion of the cover body, the inserting portion of the locking apparatus cap is designed to be inserted into the key hole of the cover body, and at the same time the pins of the locking apparatus unit mounted in the inserting portion of the locking apparatus cap engages with the engaging portion formed at the cover body to lock the cover body, thereby rejecting an external access through the key hole.

Only persons or groups authorized can easily unlock by accessing to the key hole of the cover body since the locking unit pulls the pins, only when an unlock signal is transmitted to a control chip from the outside and when the control chip receives an unlock signal from outside and admits the manhole cover to open, to disengage from the engaging portion mounted in the cover body, thus putting the key hole insertion out of the key hole.

In addition, it is economically preferred to additionally have the structure ready to have a key hole insertion without major design changing in manhole covers or manhole facilities, because it is only required to add an engaging body for engaging with pins to a key hole formed at the cover body of the preexisting manhole cover that is previously used.

When the unlock signal is transmitted from a non-contact reading and writing terminal used for identification of a person or group authorized to unlock, only when the access is admitted after identification of a person or group by the non-contact reading and writing terminal, the person or group accessible to the key hole of the manhole cover body can easily unlock where the non-contact reading and writing terminal transmits the unlock signal from outside to the control chip.

The manhole cover locking apparatus in one embodiment is characterized in that a cap holding member for receiving the key hole insertion is affixed to an outer peripheral surface of the key hole of the cover body and that the pins extendable radially outward formed at the inserting portion of the locking apparatus cap inserted into a through hole of the cap holding member toward the key hole of the cover body can be engaged with the engaging portions placed radially to the through hole of the cap holding member.

According to the above structure, the insertion body of the locking apparatus cap is inserted toward the key hole of the cover body into the through hole of the cap holding member, and the pins of the locking apparatus unit mounted in the insertion body of the locking apparatus cap engage with the engaging portions placed radially round the through hole of the cap holding member to lock the manhole cover, so that an external access to the key hole can be denied.

Only when an unlock signal is transmitted to the control chip from outside and when the control chip, receiving the unlock signal, admits to open and close the manhole cover, the locking unit pulls the pins to disengage the pins from the engaging portions of the cap holding member, so that authorized persons or groups only can easily unlock the key by accessing to the key hole of the cover body upon pulling the key hole insertion out of the cap holding member.

A structure having the key hole insertion mounted can be easily formed by only securing the cap holding member to the cover body of a conventionally used, preexisting manhole cover, so that it is economically preferred because no major change in the manhole cover or the manhole facilities is required.

The manhole cover locking system according to another embodiment of the invention is a system in which the key hole insertion attached detachably in a key hole in a cover body of a manhole cover can reject an external access to the key hole, characterized in having a personal identification tag including a personal authentication code of a person or a group who is authorized to unlock the manhole cover, a non-contact reading and writing terminal used for sending an unlock signal after recognizing the personal authentication code in the personal identification tag to identify a person or a group who is authorized to unlock the manhole cover, a control chip mounted in the key hole insertion for receiving the unlock signal sent from the non-contact reading and writing terminal to approve an opening of the manhole cover, and a locking unit mounted in the key hole insertion for unlocking the key hole insertion from the key hole upon receiving a control signal sent from the control chip.

When performing authentication and identification by the non-contact reading and writing terminal using a personal identification number and/or password or cipher, as long as one or more authenticating conditions unique only to an authorized person to access are not be satisfied, no one can access to the key hole of the manhole cover, thereby providing improved security.

In the case that input mistakes of the personal identification number and/or the password are admitted prescribed times and that the unlocking process is not authorized where the personal identification number or password is not matched after reaching the times thereby to freeze the use of the person identification tag, unlocking operation performance is improved by permitting input mistakes of a registered operator authorized to unlock the manhole cover on and before reaching the prescribed times, and also an external access by an unauthorized intruder can be refused, thereby preventing such accidents as an information leakage or subversive activities beforehand When an unlocking state of the key hole insertion to the key hole by the locking unit is designed to return to the locking state after a prescribed time passed, the key hole insertion can be automatically locked to the key hole if an operator leaves the working spot with the cover unlocked for some reasons, thereby ensuring all possible security.

When the result of the authentication and identification by the non-contact reading and writing terminal is designed to be shown on a display means mounted in the non-contact reading and writing terminal, the authorization or refusal of the access to the key hole can be easily notified, and also the reason for the refusal can be notified if necessary.

Also, when it is constructed that, after the authentication and identification is made by the non-contact reading and writing terminal, designated information stored in the control chip can be inquired with the non-contact reading and writing terminal, only an authorized person or a group can inquire about various information stored in the control chip such as roads, management data or the like, such as various plumbing diagrams, wiring diagrams or the like with the embedded incidental facilities and the property occupying roads.

Where the control chip and the locking unit have an electric power accumulating means respectively for receiving external electric power without any contact as well as for storing the electric power, the external electric power, when the manhole cover is unlocked, is fed to the electric power accumulating means without a contact, thus securing the operating power for the control chip and the locking unit.

As for the unlocking method of the locking system for manhole covers in another embodiment of the invention, using the locking system for manhole cover, the personal identification tag is recognized, as a first step, with the non-contact reading and writing terminal, and then a personal identification number and/or a password is entered to be authenticated and identified; at this stage, the non-contact reading and writing terminal transmits an unlocking signal to the control chip, and then the locking unit, upon receiving a control signal from the control chip, unlocks the key hole insertion from the key hole.

According to the unlocking method mentioned above, because only an authorized person or group can access to the key hole of the cover body of the manhole cover, while maintaining sure security, it is easily possible to unlock the manhole cover with simple operation without imposing an uncomfortable posture to the person or group in the unlocking operation.

As for the opening and closing control system for manhole covers in another embodiment of the invention, the opening and closing control system for manhole covers includes a key hole insertion detachably fitted to the key hole mounted in the cover body of the manhole cover as well as rejectable an external access; additionally in the system, there is a non-contact or contact reading type telecommunications terminal for recognizing a cover placement code of the manhole cover stored in the memory section of the control chip mounted in the key hole insertion while recognizing a personal authentication code of a personal identification tag obtained by an authorized person or group to unlock the manhole cover; and there is also a central controlling apparatus for allowing to open the manhole cover upon receiving the personal authentication code and the placement code transmitted from the non-contact or contact reading telecommunications terminal; and in the system, the non-contact or contact reading telecommunications terminal transmits an unlock signal to the control chip upon receiving an unlock-permitting signal transmitted from the central controlling apparatus, and the locking unit mounted in the key hole insertion is controlled by a control signal transmitted from the control chip, thus unlocking the key hole insertion from the key hole.

Since the invention is structured as mentioned above, the non-contact or contact reading telecommunications terminal recognizes a personal authentication code of the personal identification tag and a cover placement code of the manhole cover stored in the memory section of the control chip mounted in the key hole insertion, thereafter transmitting the personal authentication code and the placement code to the central controlling apparatus; the central controlling apparatus, in turn, effects authentication (ID) and identification of the person as well as authentication (ID) and identification of the manhole to be chosen; after the authentication and identification process, an unlock-permitting signal transmitted from the central controlling apparatus is received by the non-contact or contact reading telecommunications terminal which, in turn, transmits an unlock signal to the control chip; and according to a control signal transmitted from the control chip, the locking unit mounted in the key hole insertion is controlled for unlocking the key hole insertion from the key hole mounted in the cover body; and therefore, it is possible to lock the manhole cover surely and securely, and only the authorized person or group can easily unlock the cover.

Also, since the central controlling apparatus commands unlocking permission of the key hole insertion, the locking state or unlocking state of the manhole cover can be integrally managed, and preservation of the facilities inside manholes can be securely achieved.

In the case where the non-contact or contact reading telecommunications terminal receives an unlock-permitting signal transmitted from the central controlling apparatus and transmits the unlock-permitting signal to the control chip, and after comparison of the unlock-permitting signal is conducted inside the control chip, according to a control signal transmitted from the control chip the locking unit mounted in the key hole insertion is controlled to unlock the key hole insertion from the key hole, sure and secure preservation can be achieved by comparing an unlock-permitting signal inside the control chip.

When the central controlling apparatus monitors opening and closing states of the manhole covers based on opening cover information and closing cover information transmitted from the non-contact or contact reading telecommunications terminal, a locking state or unlocking state of the manhole covers can be managed successively and integrally; for example, a series of operational proceeding status of a construction can be recognized by monitoring the opening cover information and closing cover information of a plural manhole covers, or by mapping the opening cover information and the closing cover information, such information is also available to traffic information or the like.

When it is constructed such that designated information stored in the central controlling apparatus can be inquired by the non-contact or contact reading telecommunications terminal at the stage where the central controlling apparatus admits the opening cover of the manhole cover, only an authorized person or group can inquire about various information stored in the central controlling apparatus such as roads, management data or the like, such as various plumbing diagrams, wiring diagrams or the like with the embedded incidental facilities and the property occupying roads.

BRIEF DESCRIPTION OF THE DRAWINGS

The above and other objects and features of the invention are apparent to those skilled in the art from the following referred embodiments thereof when considered in conjunction with the accompanied drawings, in which:

FIG. 2 (*b*) and FIG. 2 (*c*) are schematic plan views showing states of opening and closing a manhole cover by rotating arms in a locking portion of the locking apparatus of the manhole cover;

FIG. 5 (*b*) is a cross-sectional view showing a state in which the key hole insertion is inserted and locked in the cap holding member mounted at the outer peripheral surface portion of the key hole of the manhole cover according to the first embodiment of the invention;

FIG. 12 (*b*) is a cross-sectional view showing a state in which the key hole insertion is inserted and locked in the key hole of the manhole cover according to the second embodiment;

FIG. 13 (*b*) is a cross-sectional view showing a state in which the key hole insertion is inserted and locked in the cap holding member mounted at the outer peripheral surface portion of the key hole of the manhole cover according to the third embodiment;

FIG. 14 (*b*) is a cross-sectional view showing a state in which the key hole insertion is inserted and locked in the key hole of the manhole cover according to the fourth embodiment;

FIG. 15 (*b*) is a cross-sectional view showing a state in which the key hole insertion is inserted and locked in the key hole of the manhole cover according to the fifth embodiment;

FIG. 17 (*b*) is a plan view showing a structure of the rotary-opening type manhole cover;

FIG. 19 is a view showing an embodiment of a personal authentication code and a placement code of a manhole cover;

FIG. 22 (*b*) is a view explaining an embodiment of prior art.

DETAILED DESCRIPTION OF PREFERRED EMBODIMENTS

Figure 1:
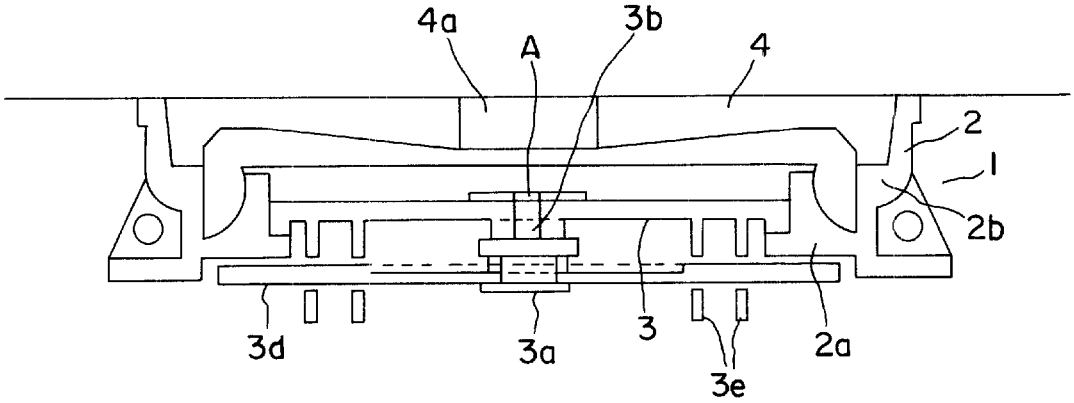
FIG. 1 is a cross-sectional view showing an embodiment of a double manhole cover, the inner cover of which a key cover insertion for a manhole cover according to the invention as well as a locking apparatus of the manhole cover utilizing the key hole insertion according to the invention are applied.

Referring to the drawings, embodiments of a key hole insertion for a manhole cover, a manhole cover locking apparatus using the key hole insertion, a manhole cover locking system, an unlocking method and a manhole cover opening and closing control system according to the invention are explained. Manhole covers to be explained include handhole covers.

Figure 2A:
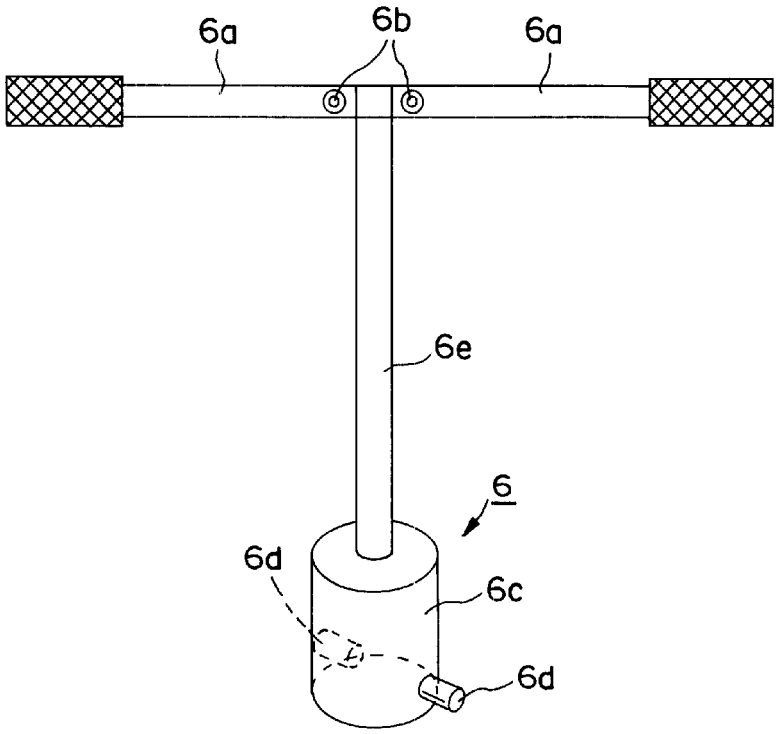
FIG. 2(a) PRIOR ART
FIG. 2 (*a*) is a perspective view showing an embodiment of an operating key for a locking apparatus of a manhole cover.
Figure 2C:
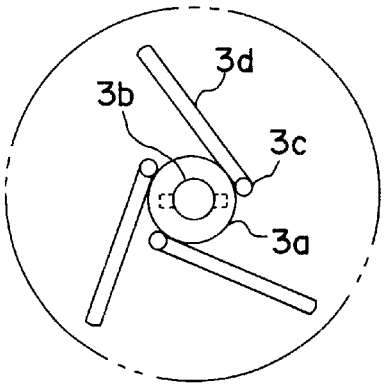
FIG. 2(c) PRIOR ART
Figure 2B:
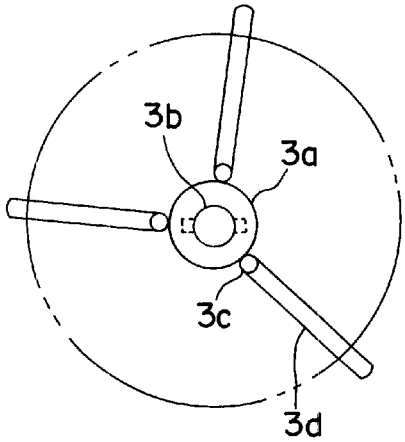
FIG. 2(b) PRIOR ART
Figure 3:
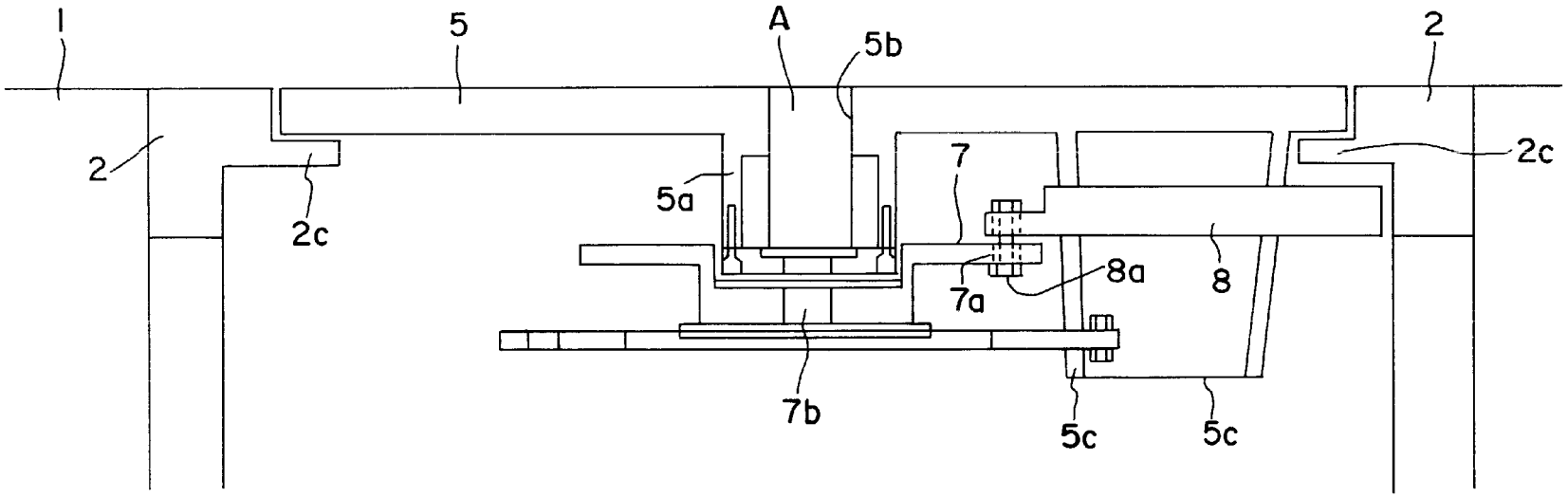
FIG. 3 is a cross-sectional view showing an embodiment of a one-plate manhole cover to which a key hole insertion of the manhole cover according to the invention as well as a locking apparatus of the manhole cover utilizing the key hole insertion according to the invention are applied.
Figure 4:
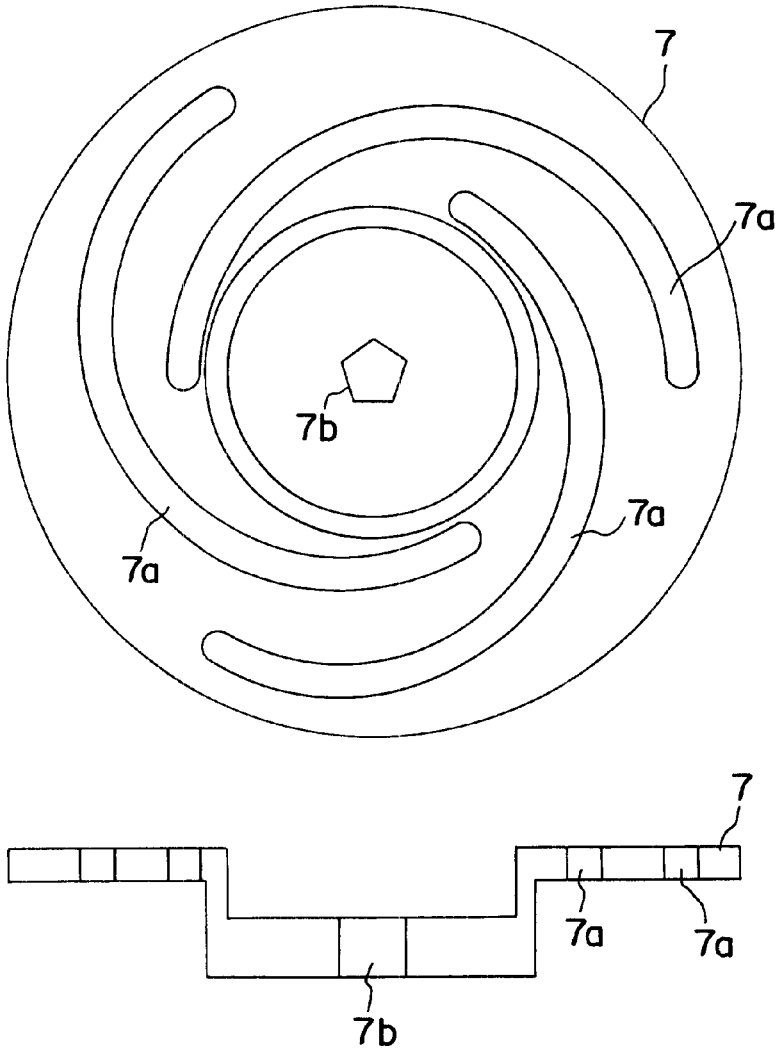
FIG. 4 PRIOR ART
FIG. 4 is a view showing a structure of a crank plate forming whirling-formed grooves for opening and closing the arms of the locking portion of the locking apparatus of the manhole cover.

FIG. 1 is a cross-sectional view showing an embodiment of a double manhole cover, to the inner cover of which a manhole cover key hole insertion of the invention and a manhole cover locking apparatus equipped with the key hole insertion of the invention are applied; FIG. 2 (*a*) is a perspective view showing an embodiment of an operating key for the locking apparatus of the manhole cover; FIG. 2 (*b*) and FIG. 2 (*c*) are schematic views showing that arms in the manhole cover locking apparatus are pivotally rotating for opening and closing the cover; FIG. 3 is a cross sectional view showing an embodiment of a one-plate manhole cover having a key hole insertion for a manhole cover and a manhole cover locking apparatus equipped with the key hole insertion in accordance with the invention; FIG. 4 shows a structural view of a crank plate having whirling-formed grooves used for opening and closing the arms in the locking apparatus portion of the manhole cover locking apparatus.

Figure 5A:
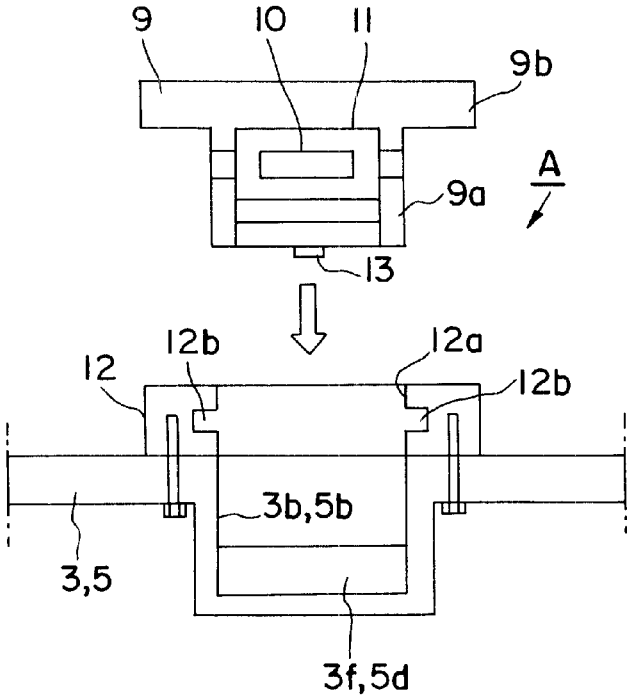
FIG. 5 (*a*) is a cross-sectional view showing a state in which a key hole insertion is being inserted in a cap holding member mounted at an outer peripheral surface portion of the key hole of the manhole cover according to the first embodiment of the invention.
Figure 5B:
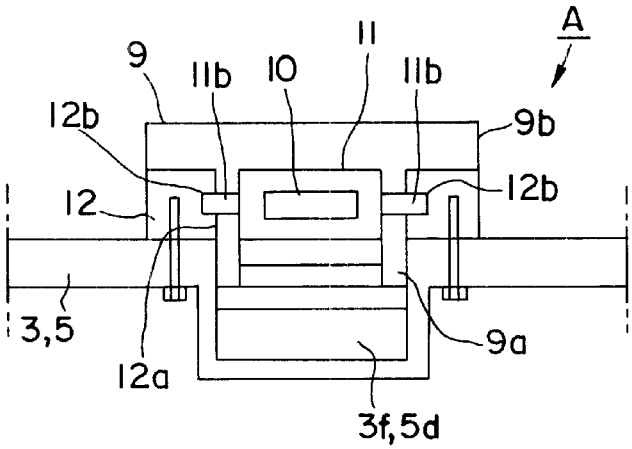
Figure 6:
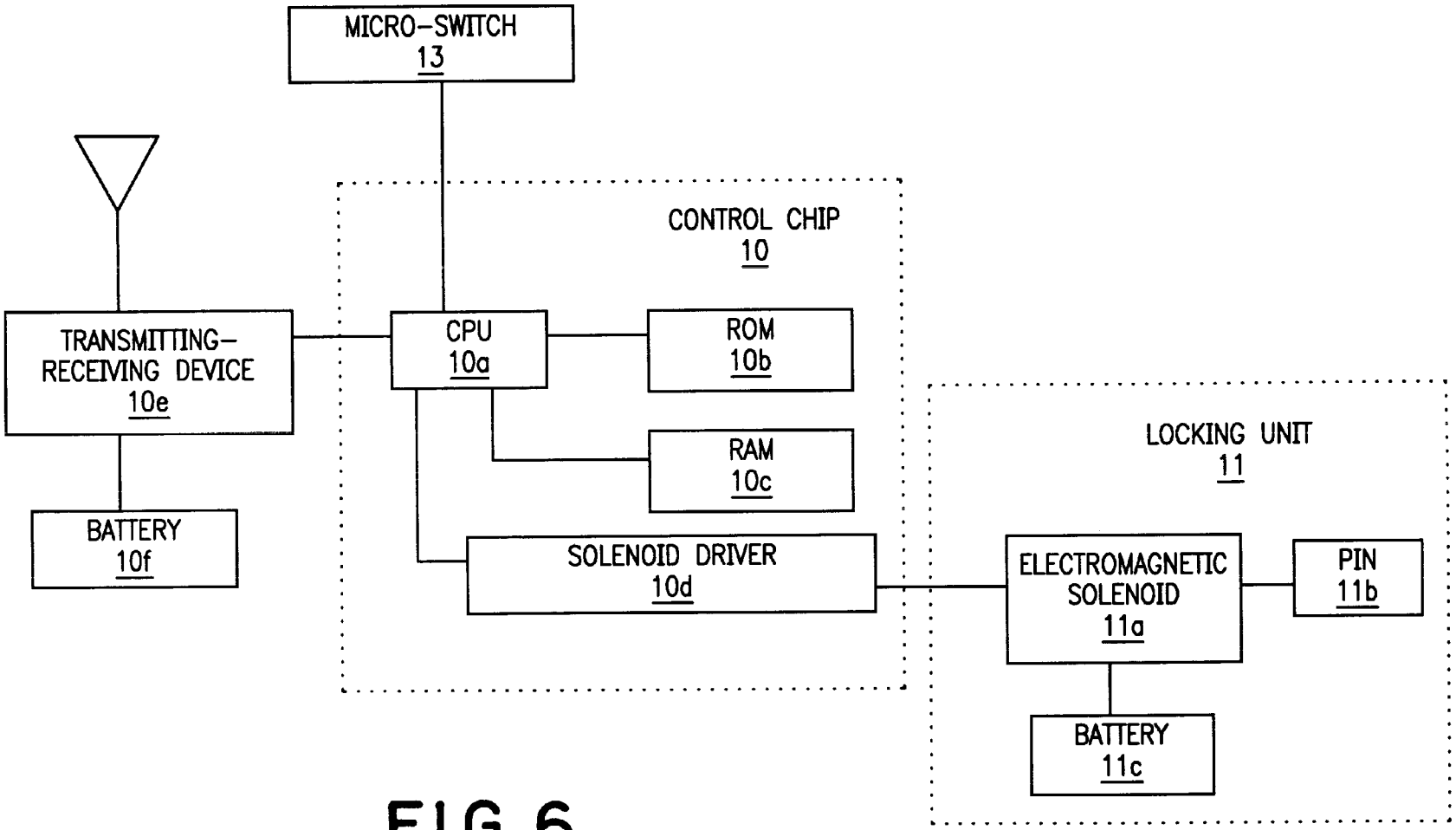
FIG. 6 is a block diagram showing a structure of a control chip and a locking unit.
Figure 7:
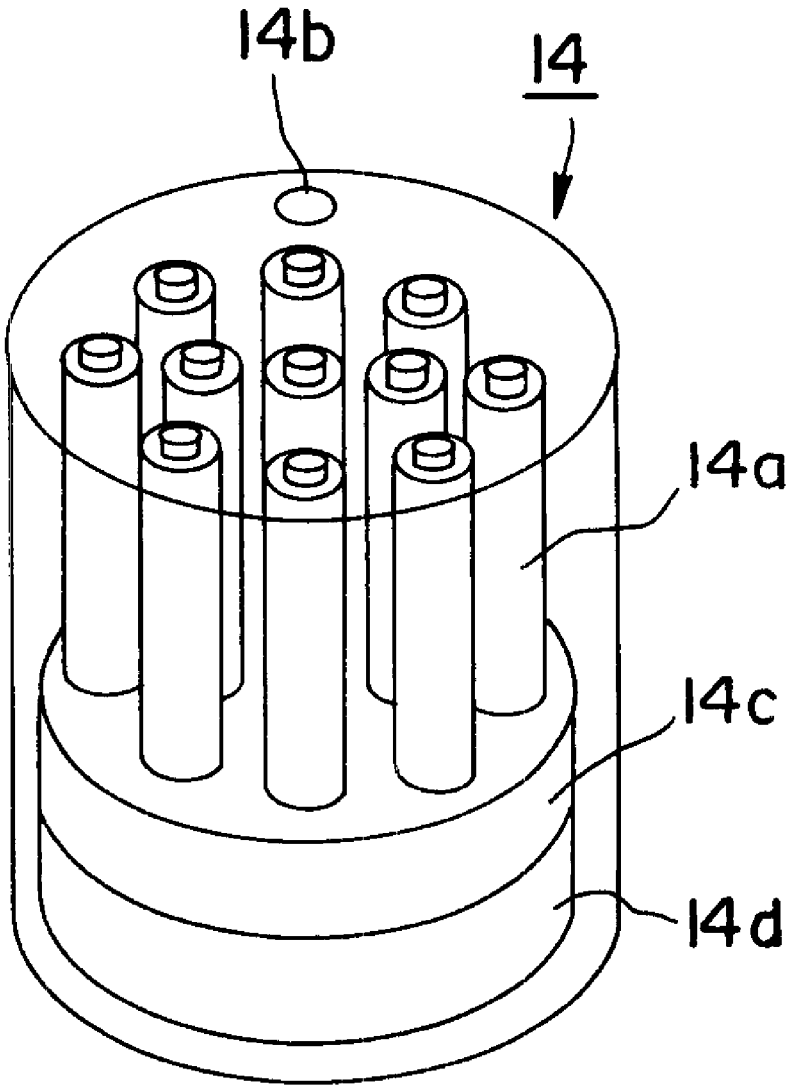
FIG. 7 is a perspective view showing a structure of the electromagnetic induction power source.
Figure 8:
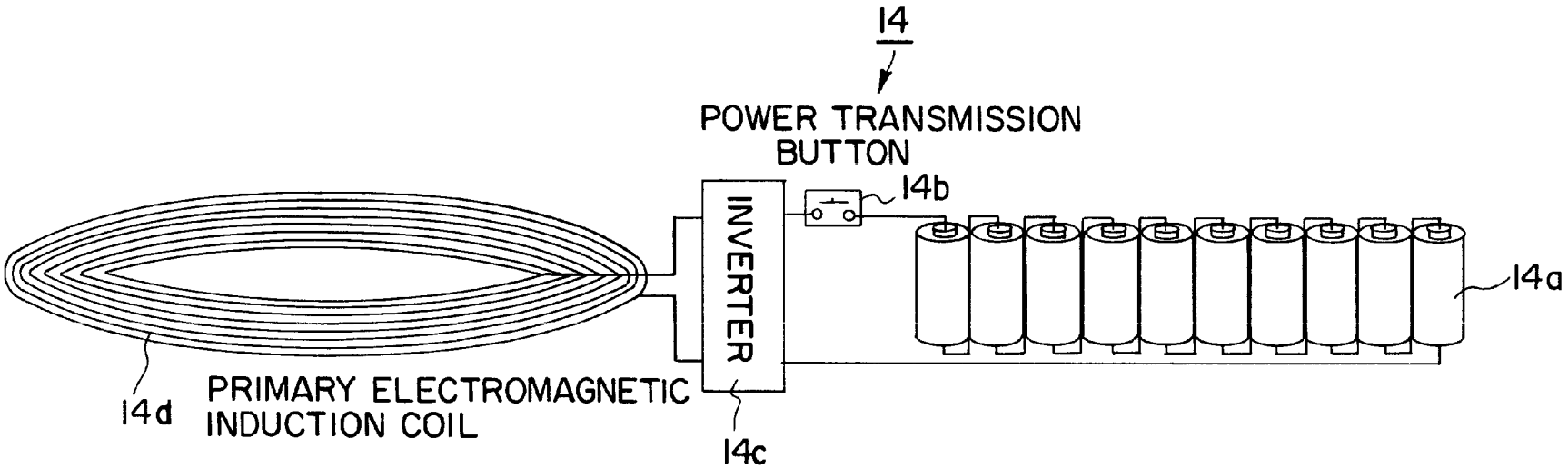
FIG. 8 is a view showing a circuit structure of electromagnetic induction power source.
Figure 9:
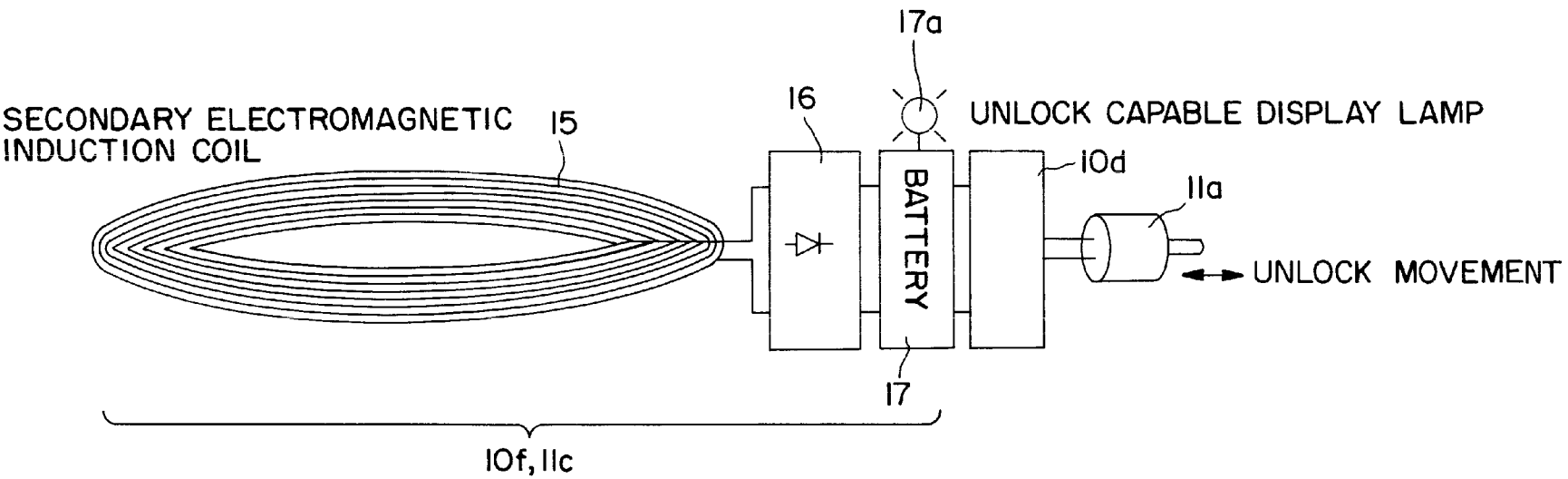
FIG. 9 is a view showing a circuit structure for receiving electric power from the electromagnetic induction power source by electromagnetic induction.
Figure 10:
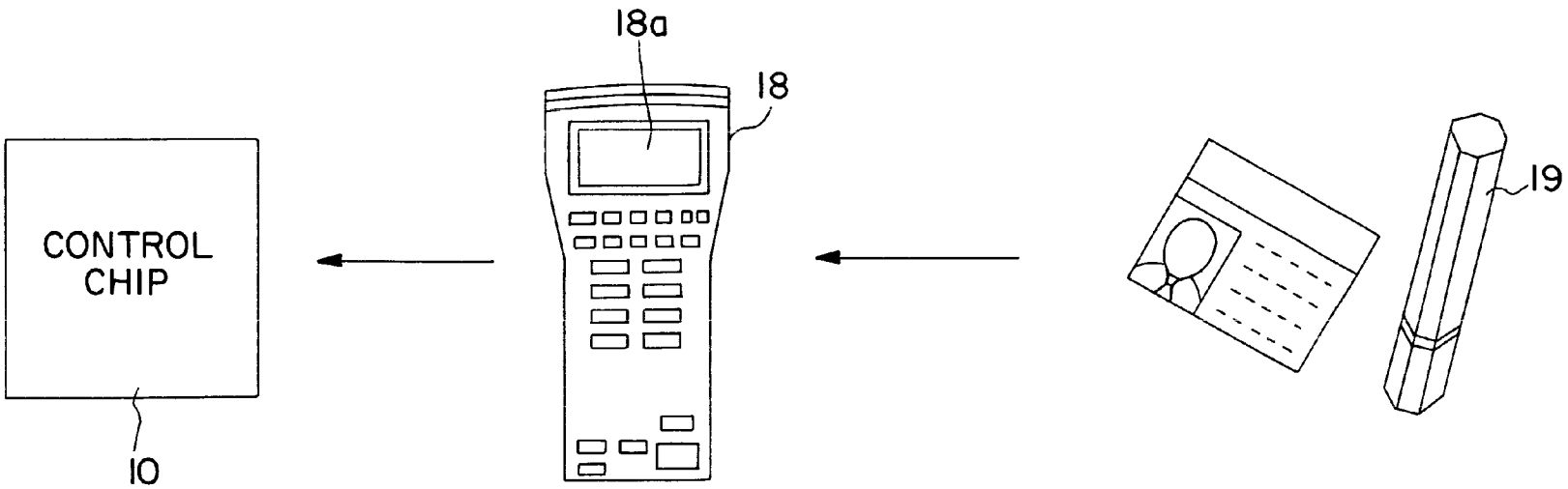
FIG. 10 is a view showing a state in which ID identification is made by a personal identification means and a non-contact reading and writing terminal.
Figure 11:
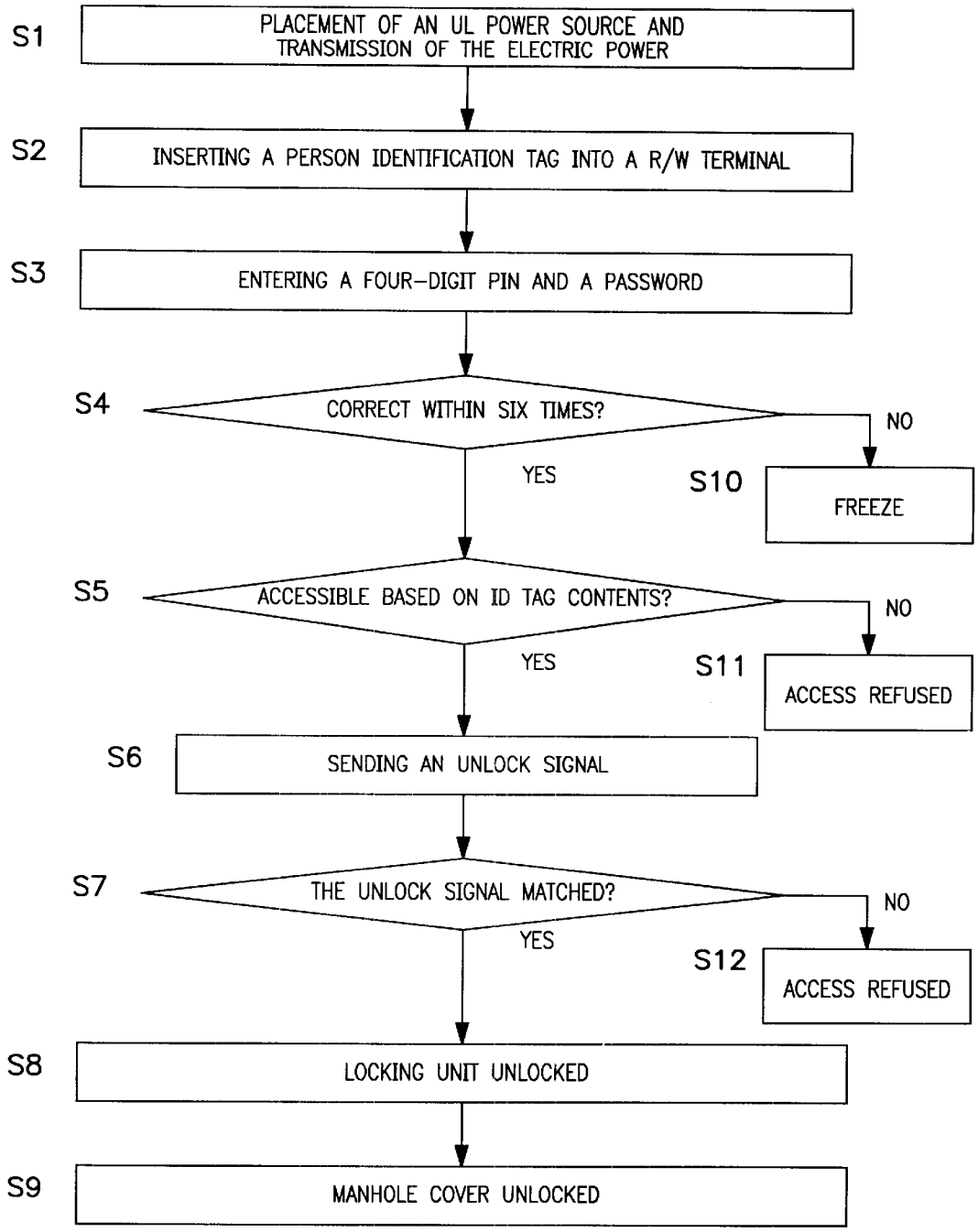
FIG. 11 is a flowchart showing steps for unlocking the manhole cover.

FIG. 5 (*a*) is a cross-sectional view showing a state in which a key hole insertion is being inserted in a cap holding member mounted at an outer peripheral surface portion of the key hole of the manhole cover according to the first embodiment of the invention; FIG. 5 (*b*) is a cross-sectional view showing a state in which the key hole insertion is inserted and locked in the cap holding member mounted at the outer peripheral surface portion of the key hole of the manhole cover according to the first embodiment of the invention; FIG. 6 is a block diagram showing a structure of a control chip and a locking unit; FIG. 7 is a perspective view showing a structure of the electromagnetic induction power source; FIG. 8 is a view showing a circuit structure of electromagnetic induction power source; FIG. 9 is a view showing a circuit structure for receiving electric power from the electromagnetic induction power source by electromagnetic induction; FIG. 10 is a view showing a state in which ID identification is made by a personal identification means and a non-contact reading and writing terminal; FIG. 11 is a flowchart showing steps for unlocking the manhole cover.

The drawings of the FIG. 1 to FIG. 4 describe a structure of manhole covers (including handhole covers) for a manhole including a handhole placed as an opening connecting from underground equipment or underground structural facilities up to the ground. Shown in FIG. 1 is an embodiment of a double manhole cover having an inner cover and an outer cover; and in FIG. 3 is an embodiment of a one-plate manhole cover that only includes an outer cover.

In FIG. 1, an inner manhole cover 3 is supported by an inner cover supporting portion 2*a* of a cover receiving frame 2 resting at substantially the same level as the surface of the ground 1, and an outer manhole cover 4 is supported by an outer cover supporting portion 2*b* of the cover receiving frame 2. In FIG. 3, a manhole cover 5 is supported by the cover receiving frame 2 which rests at substantially the same level the surface of the ground 1.

The manhole cover mentioned above is applicable to, e.g., large-sized iron covers able to be open and closed to cover an opening connecting from the underground equipment of the underground sewer systems or underground structural facilities or the like up to the ground, swage disposal box covers, openable ditch iron covers for protecting underground facility devices or electrical lines used for electric powers and telecommunications; iron covers for power supply, iron covers for wiring, fire-hydrant covers with a function as an open-close door connecting from underground pipes below roads for such as ground water and sewer lines or gas pipes and the accessory devices to the ground, gate valve covers, partition valve covers, air valve covers, gas plumbing covers, water meter covers, and the like.

The inner manhole cover 3 shown in FIG. 1 has a locking means for mechanically engaging the inner manhole cover 3 with the cover receiving frame 2 for locking the lock. With the manhole outer cover 4 removed, as shown in FIGS. 2(*b*), 2(*c*), a cover-opening handle key 6 shown in FIG. 2 (*a*) is inserted in a key hole 3*b* of a locking portion 3*a* mounted at a center of the inner manhole cover 3, and the key 6 is thereafter rotated; consequently, each arm 3*d* formed pivotally at a hinge portion 3*c* placed on the outer periphery of the locking portion 3*a* rotates around the locking portion 3*a* as a center as a united body with the hinge portion 3*c* as pivotally moving around the hinge portion 3*c*. Each arm guide 3*e* mounted in the inner manhole cover 3 guides the arm 3*d* to the locking position and to the unlocking position; in the locking position, each arm 3*d* is fittingly engaged with a bottom surface of the inner cover receiving portion 2*a* to be stopped; in the unlocking position, on the other hand, each arm 3*d* is retracted toward the locking portion 3*a* being further inside than the inner cover receiving portion 2*a*.

A portion 4*a* corresponding to an upper portion of the locking portion 3*a* of the inner manhole cover 3 at least around a center of the manhole outer cover 4, is made of a non-magnetic stainless material, so that there is no hindrance to transmission of power produced by an UL power source 14 utilizing electromagnetic induction, which is to be explained below.

As for the cover-opening handle key 6 shown in FIG. 2 (*a*), where each handle part 6*a* has been folded with respect to a corresponding rotating axis 6*b*, projections 6*d* are pulled to be inside the key body 6*c* which is to be inserted in the key hole 3*b* of the locking portion 3*a* placed on the center of the inner manhole cover 3. The handle parts 6*a* are unfolded while rotating around the respective rotating axes 6*b* as shown in FIG. 2 (*a*), the projections 6*d* are outwardly protruded from the outer peripheral surface of the key body 6*c* to engage with the engaging portion, not shown, of the locking portion 3*a*. By rotating the handle parts 6*a* around a shaft 6*e* as a center, the arms 3*d* are moved pivotally as shown in FIGS. 2(*b*), (*c*) to lock and unlock the inner manhole cover 3.

The manhole cover 5 shown in FIG. 3 has also a locking means by which the manhole cover 5 is mechanically engaging with the cover receiving frame 2. With the locking means, a handle key for opening a cover, not shown, is inserted in the key hole 5*b* formed in the locking portion 5*a* located at a center of the manhole cover 5 to engage with an engaging hole 7*b* provided in a rotatable disk 7 disposed at a lower portion of the locking portion 5*a* as shown in FIG. 4. Rotation of the key is translated to movements of arms 8, which are fitted in whirling-formed grooves 7*a* formed on the rotatable disk 7 at the outer periphery of the locking portion 5*a* and secured to corresponding supporting axes 8*a* which are movable along the whirling-formed grooves 7*a*. The arms 8 secured to the movable support axes 8*a* move along with the whirling-formed grooves 7*a* to be guided by arm guides 5*c* mounted on the manhole cover 5, and therefore, the arms 8 can be in a lock position in which the arms 8 are engaged with the bottom surface of the engaging portion 2*c* of the cover receiving portion 2, or be in an unlocked position in which the arms 8 are retracted toward the locking portion 5*a* placed further inside than the cover receiving portion 2.

In FIGS. 5(*a*) and (*b*), numeral A designates a key hole insertion detachably attached to the key hole 3*b* mounted in the inner manhole cover 3 shown in FIG. 1 or to the key hole 5*b* mounted in the manhole cover 5 shown in FIG. 3, and the key hole insertion A has a locking cap 9 able to prevent an external access to the key hole 3*b* or 5*b*, and a control chip 10 and a locking unit 11, which are formed inside the inserting portion 9 of the locking cap 9.

Numeral 12 designates a cap holding member to hold the locking cap 9, being secured by bolts, welding or the like to the outer peripheral surface of the key hole 3*b* of the inner manhole cover 3 or the key hole 5*b* of the manhole cover 5. A through hole 12*a* having a cross section almost matching the shape of the key hole 3*b* or the key hole 5*b* at substantially a center of the cap holding member 12.

The locking cap 9 includes an inserting portion 9*a* to be downwardly inserted through the key hole 3*b* or the key hole 5*b* in the through hole 12 a of the cap holding member 12, and a brim portion 9*b* in contact with the surface of the cap holding member 12. When the key hole insertion A is inserted through the key holes 3*b* and 5*b* into the through hole 12*a* of the cap holding member 12, an actuator of a micro-switch 13 mounted on the tip of the inserting portion 9*a* of the locking cap 9 is pushed downwardly enough to contact with the surface of a lock 3*f* of the locking portion 3*a* of the inner manhole cover 3 or with a surface of a lock 5*d* of the locking portion 5*a* of the manhole cover 5, thereby turning on the micro-switch 13 to detect the insertion of the key hole insertion A into the inner manhole cover 3 or the manhole cover 5.

Mounted inside the inserting portion 9*a* are an a control chip 10 for authorizing the opening of the inner manhole cover 3 or the manhole cover 5 based on the reception of an unlock signal transmitted from the outside and a locking unit 11 for unlocking the key hole insertion A from the key holes 3*b* of the inner manhole cover 3 or the key hole 5*b* of the manhole cover 5 based on the control signal sent from the control chip 10 (see, FIG. 6).

The control chip 10 is manufactured as an integral package with an IC (semiconductor integrated circuit) chip, an LSI (semiconductor large-scaled integration) chip or the like, and the chip 10 accommodates a CPU 10*a*, a ROM 10*b*, and a RAM 10*c* inside as shown in FIG. 6. The CPU 10*a* connects to a solenoid driver 10*d*, to a transmitting-receiving device 10*e* for receiving the unlock signal sent from the outside and a battery 10*f* for accumulating power received from the outside.

The CPU 10*a* is a central processing unit for reading programs or various data stored in the ROM 10*b* as explained below, for processing and judging required matters, and then for controlling the each matters. The CPU 10*a* has a counter for counting the passing time after the start of driving of the solenoid driver 10*d*.

The ROM 10*b* is a read-only-memory and includes various programs for operations in the CPU 10*a* and various data required for comparing a personal identification number and a password or a cipher transmitted from outside. The ROM 10*b* stores management data such as various plumbing or wiring diagrams with information about roads, those management incidental facilities or property occupying roads. The ROM 10*b* also stores the various messages to be shown on a display 18*a* as a displaying means for indicating results of the confirmation and identification given by a reading and writing terminal 18 to be explained below.

The RAM 10*c* is a random access memory and made of, such as, a working area in which the CPU 10*a* temporarily stores the data during instructions or the operation results, a buffer area storing various data on the personal identification number, the password and the like transmitted from the outside.

The battery 10*f* as a storage means receives electric power used for the control chip 10 from outside in a non-contact manner, and temporarily stores the electric charge at every unlocking operation of the key hole insertion A. The battery 10*f* is charged using substantially the same electromagnetic induction effect as a battery 11*c* of a locking unit 11 to be explained below.

The locking unit 11 has an electromagnetic solenoid 11*a* driven and controlled by the solenoid driver 10*d*, and an extendable and retractable pin lib controlled by the electromagnetic solenoid 11*a*. The electromagnetic solenoid 11*a* is fed with required electric power for drive from the battery 11*c* as a battery means in which the electric power is received in a non-contact manner from the outside and temporarily stored. The battery 11*c* is not such an apparatus for being used as a long-term battery, and the key hole insertion A has no power source used for locking and unlocking on its own.

The pins 11*b* driven by the electromagnetic solenoid 11*a*, as shown in FIG. 5(*b*), are protruding radially outward from the inserting portion 9*a* of the locking cap 9 to engage with engaging openings 12*b* as engaging portions that radially extend and are provided on a side of the through hole 12*a* of the cap holding member 12. The pins 11*b* are designed to be extendable and retractable by the electromagnetic solenoid 11*a* based on the control signal transmitted from the solenoid driver 10*a* of the control chip 10.

According to FIG. 7 and FIG. 8, numeral 14 designates an electromagnetic induction power source referred as an UL (Unlock) power source below, used for supplying power to batteries 10*f* and 11*c* of the control chip 10 and of the locking unit 11. In the UL power source 14, a direct current power in which plural batteries 14*a* are connected in series is applied to the inverter 14*c* that converts the direct current into the alternating current upon pushing down a power transmitting button 14*b*, and the alternating current outputted from the inverter 14*c* flows into a primary electromagnetic induction coil 14*d*, thus generating an alternate magnetic field.

The battery 10*f* and the battery 11*c*, which serve as the control chip 10 and the locking unit 11, respectively, as shown in FIG. 9 have the secondary electromagnetic coil 15 for generating an electromotive force induced by the electromagnetic effects of the alternate magnetic field created in the primary electromagnetic induction coil 14*d* of the UL power source 14. A rectifier 16 connected to the secondary electromagnetic coil 15 converts the direct current into alternating current, resulting in charging electric power into a battery 17 made of such as capacitors or the like.

Numeral 17*a* designates a display lamp emitting light when the capacitor 17 accumulates a required amount of the power for operating the control chip 10 and locking unit 11.

FIG. 9 shows a configuration of the battery 11*c* of the locking unit 11, and substantially the identical configuration is given to the battery 10*f* of the control chip 10.

FIG. 10 and FIG. 11 show the unlocking process of the key cover insertion A using the non-contact reading and writing terminal 18 (hereinafter, referred as a R/W terminal) for authenticating and identifying a person or a group authorized to unlock the manhole. The operator, when unlocking the manhole cover, accesses to the manhole cover to be open in carrying the R/W terminal 18, a personal identification tag 19 and the UL power source 14.

With the key hole insertion A in the locked position as shown in FIG. 5 (*b*), the key hole insertion A is fitted through the cap holding member 12 secured to the outer surface of the key hole 3*b* of the inner manhole cover 3 or the key hole 5*b* of the manhole cover 5, and the pins 11*b* are protruding into the engaging openings 12*b* of the cap holding member 12, thus engaging to lock the cover.

The operator first places the UL power source 14 as described above and shown in FIG. 7 and FIG. 8 on the key hole insertion A being fitted in the inner manhole cover 3 where the manhole outer cover 4 is removed, or on the key hole insertion A being fitted in the manhole cover 5, and then presses a power transmission button 14*b* for about ten seconds to transfer the electric power to the battery 10*f* of the control chip 10 and the battery 11*c* of the locking unit 11 from the UL power source 14. (step S1 in FIG. 11) When the operator confirmed by turning on the flashing light of the display lamp 17*a* that enough electric power is charged, he releases the power transmission button 14*b*.

The personal identification tag 19 including a personal authentication code of the person or group authorized to unlock the manhole cover as shown in FIG. 10 is inserted into a tag slot, not shown, of the R/W terminal 18 (step S2 in FIG. 11), and then the four-digit personal identification number (or user ID) and the password or cipher are entered (step S3 in FIG. 11).

As for the R/W terminal 18, it is admitted to input any wrong personal identification number and password up to six times respectively, but when erroneous entries are made serially six times, the display means, or the display 18*a* of the R/W terminal 18 shows a message such as "Access refused" or the like. In addition, the personal authentication tag 19 itself freezes (step S10 in FIG. 11), which becomes unusable until it is reset at the tag publishing center in which personal authentication tags 19 are issued and managed.

As for Step S4 in FIG. 11, when the personal identification number and the password are correct respectively within six times, the R/W terminal 18 confirms the personal identification number and the password, then shows on the display 18*a* messages "Personal identification number confirmed" and "Password confirmed" or the like. At step S5 in FIG. 11, an access to the key hole 3*b* of the inner manhole cover 3 or the key hole 5*b* of the manhole cover 5 is judged based on authentication and identification contents read from the personal authentication tag 19. In this process, when the judgment s made to refuse the access at step in FIG. 11, the access is rejected (step S11 in FIG. 11), and then a message "Access refused" or the like is shown on the display 18*a* of the R/W terminal 18.

At the step S5, the operator, when authorized to access, can have choices with the operational button on the R/W terminal 18; opening the inner manhole cover 3 or the manhole cover 5, or only referring to a variety of information, without opening the inner manhole cover 3 or the manhole cover 5, stored in the ROM 10*b* of the control chip 10 about management data such as various plumbing or wiring diagrams with information about roads, those management incidental facilities or property occupying roads.

Accordingly, at step S5, when the access is authorized, and when the operator controls the operational button on the R/W terminal 18 for commanding the opening of the inner manhole cover 3 or the manhole cover 5, the R/W terminal 18 transmits an unlock command and the personal authentication code as the unlock signal to the control chip 10 (step S6 in FIG. 11).

According to step S7 in FIG. 11, the control chip 10, after receiving the unlock signal using the transmitting-receiving device 10*e* sent from the R/W terminal 18, temporarily stores the unlock signal in the RAM 10*c*, and then the CPU 10*a* refers to the access-permitting unlock signal previously stored in the ROM 10*b*. When the access is judged as from the authorized person or group, the CPU 10*a* controls the solenoid driver 10*d* with charged power in the battery 11*c* to drive the electromagnetic solenoid 11*a* for pulling the pins 11*b* inward, which allow the locking unit 11 to be unlocked (step S8 in FIG. 11). Accordingly, the pins 11*b* are disengaged from the engaging openings 12*b* of the cap holding member 12 to move the locking cap 9 to a detachable position from the cap holding member 12.

The operator lifts the locking cap 9 out of the cap holding member 12, and inserts the cover opening handle key 6 and the like as shown in FIG. 2(*a*) through the key hole 3*b* of the inner manhole cover 3 or the key hole 5*b* of the manhole cover 5 to unlock the lock of the inner manhole cover 3 or manhole cover 5 (step S9 in FIG. 11).

With respect to Step S8, because an unlocking time is set for ten seconds during which the electromagnetic solenoid 11*a* is pulling the pins inward 11*b* for unlocking the locking unit 11, if the key hole insertion A is not pulled out of the cap holding member 12 within ten seconds, the CPU 10*a* starts controlling the solenoid driver 10*d* to turn off the electromagnetic solenoid 11*a*. As a result, the pins 11*b* are projecting again for engaging with the engaging opening 12*b* of the cap holding member 12 and consequently lock the locking cap 9 to the cap holding member 12.

When the key hole insertion A is locked, if the inserting portion 9*a* in the locking cap 9 is downwardly inserted toward the key hole 3*b* of the inner manhole cover 3 or the key hole 5*b* of the manhole cover 5 into the through hole 12*a* of the cap holding member 12, an actuator of the micro-switch 13 mounted on the tip of the inserting portion 9*a* is pushed in contact with the surface of the lock 3*f* or 5*d*, turning on the micro-switch 13. Based on this detection information, the CPU 10*a* controls the solenoid driver 10*d* to turn off the electromagnetic solenoid 11*a* of the locking unit 11, thereby locking the key cover insertion A to the inner manhole cover 3 with the pins 11*b* in engagement with the engaging openings 12*b* of the cap holding member 12.

As for the power used in operating the locking unit 11 at that time, the electric power temporarily charged in the previous time in the battery 11*c* in the method and manner as mentioned above is used. This locking operation does not require the R/W terminal 18 and the personal authentication tag 19.

Referring to the Step S5, when the operator, after given an access authorization, controls the operation button on the R/W terminal 18 without opening the inner manhole cover 3 or the manhole cover 5 to execute instructions for referring to the various information stored in the ROM 10*b* in the control chip 10 about management data such as various plumbing or wiring diagrams with information about roads, those management incidental facilities or property occupying roads or the like, the R/W terminal 18 transmits an inquiry command and the personal authentication code in a form of an inquiry signal to the control chip 10.

The control chip 10, receiving the inquiry signal from the R/W terminal 18 with the transmitting-receiving device 10*e*, stores the inquiry signal temporarily in the RAM 10*c* to retrieve the required the information previously stored in the ROM 10*b* of the control chip 10 about management data such as various plumbing or wiring diagrams with information about roads, those management incidental facilities or property occupying roads or the like, and then displays the information on the display 18*a* of the R/W terminal 18.

According to the mentioned structure, since the locking unit 11 conditionally unlocks the key hole insertion A from the key hole 3*b* or key hole 5 of the inner manhole cover 3 or the manhole cover 5 only when the R/W terminal 18 recognizes the personal authentication code of the personal identification tag 19 to identify the personal identification (ID) and then transmits from the outside the unlock signal to the control chip 10, a secure and severe locking of the inner manhole cover 3 or the manhole cover 5 can be done.

In other words, after the inserting portion 9*a* of the locking cap 9 is inserted through the key hole 3*b* of the inner manhole cover 3 or the key hole 5*b* of the manhole cover 5 into the through hole 12*a* of the cap holding member 12, the CPU 10*a*, upon receiving the detecting signal from the micro-switch 13, controls the solenoid driver 10*d* to turn off the electromagnetic solenoid 11*a*, and then, the pins 11*b* of the locking unit 11 are engaged to lock with the engaging openings 12*b* formed radially around the through hole 12*a* of the cap holding member 12, thus preventing an external access to the key hole 3*b* of the inner manhole cover 3 or the key hole 5*b* of the manhole cover 5.

Only when the control chip 10 permits the locking apparatus to be open or close after receiving the unlock signal from the outside, the locking unit 11 pulls the pins 11*b* inward to disengage the pins 11*b* from the engaging openings 12*b* to get the key hole insertion A out of the cap holding member 12, so that the only person or group authorized can access to the key hole 3*b* of the inner manhole cover 3 or the key hole 5*b* of the manhole cover 5 to easily unlock the lock.

In order to make a structure ready for easily mounting the key hole insertion A, it is only required to affix the cap holding member 12 to the conventional inner manhole cover 3 or manhole cover 5, without any major structural changes, and therefore, it is economically preferred.

Since the R/W terminal 18, designed to effectuate the authentication and identification of the authorized person or group, is also designed to transmit the unlock signal, only when the R/W terminal 18 permits an access after the authentication and identification of the person or group, the R/W terminal 18 can send the unlock signal to the control chip 10 from the outside. Thus, the only person or group authorized to unlock can make an access to the key hole 3*b* of the inner manhole cover 3 or the key hole 5*b* of the manhole cover 5 to easily unlock the lock.

Also, improved security is provided by blocking any access to the key hole 3*b* of the inner manhole cover or the key hole 5*b* of the manhole cover 5 unless one or plural conditions of the confirmation process are made clear which are known only to the authorized person to access upon utilizing a personal identification number (or user ID) and a password or cipher for authentication and identification done by the R/W terminal 18.

Entering wrong personal identification numbers and/or passwords can be permitted within a certain number of times, and if a person does not enter a correct password or the like within the required times, the unlocking process is not authorized, as well as the use of the personal identification tag 19 is frozen. At the same time, this structure allows the person who is authorized to unlock the inner manhole cover 3 or the manhole cover 5 to make input mistakes as long as within the prescribed times, thus improving workability of the unlocking operation while blocking an external access by an unauthorized intruder to prevent such accidents as information leakage or subversive activities beforehand.

Since the unlocking state of the key hole insertion A with respect to the key hole 3*b* or 5*b* controlled by the locking unit 11 is designed to go automatically back to the locking state after a prescribed time passes, if the operator left the site for some reason without locking the manhole, the key hole insertion A is automatically going back to the unlocked state with respect to the key hole 3*b* or 5*b* after passing the prescribed time, thereby ensuring all possible security.

Since the R/W terminal 18 can output the authentication and identification results on the display 18*a*, an operator can easily know whether the access is authorized or refused and also receive, if necessary, the reason for the access refusal.

According to the structure, since the R/W terminal 18, after performing the authentication and identification, can inquire about information stored in the ROM 10*b* of the control chip 10 such management data as various plumbing or wiring diagrams with information about roads, those management incidental facilities or property occupying roads, the authorized person or group only can obtain the above variety of information, and therefore, the information can be precisely, promptly, and easily collected on the construction site, which facilitates the effectiveness of patrol, and on-site examination, construction, and on-site meeting for construction works.

Since the control chip 10 and the locking unit 11 respectively have power storing means, or batteries 10*f* and 11*c*, for receiving external electric power without any contact as well as for storing the electric power inside, when the inner manhole cover 3 or the manhole cover 5 is unlocked, operation electric power of the control chip 10 and the locking unit 11 can be ensured by supplying the electric power to the batteries 10*f*, 11*c* from the outside in a non-contacting manner.

According to the unlocking method mentioned above, while sound security is obtained by the method in which the only authorized person or group can access to the key hole 3*b* of the body of the inner manhole cover 3 or the key hole 5*b* of the body of the manhole cover 5, the unlocking method provides the simple unlocking process with an easy manipulation without imposing an uncomfortable posture.

The apparatus of the embodiment according to the invention particularly has the control chip 10 having the CPU 10*a* and the ROM 10*b*, and therefore, different persons or groups authorized to access can be registered with respect to manholes (including handholes) respectively.

In other words, the apparatus can set in a manner in which a manhole x (or handhole x), for example, is only accessible by a group x and a manhole y (or handhole y) is only accessible by a group y, but a manhole z (or handhole z) is accessible by both group x and y.

Although it is explained according to the embodiment mentioned above that the engaging openings 12 b in the cap holding member 12 are used as an engaging portion for engaging with the pins 11 of the locking unit 11, there might be another structure with an alternative engaging portion in which each projecting portion extending radially inward from the through hole 12*a* of the cap holding member 12 is provided for contacting and engaging an underside of each projecting portion with a corresponding pin 11*b*.

Figure 12A:
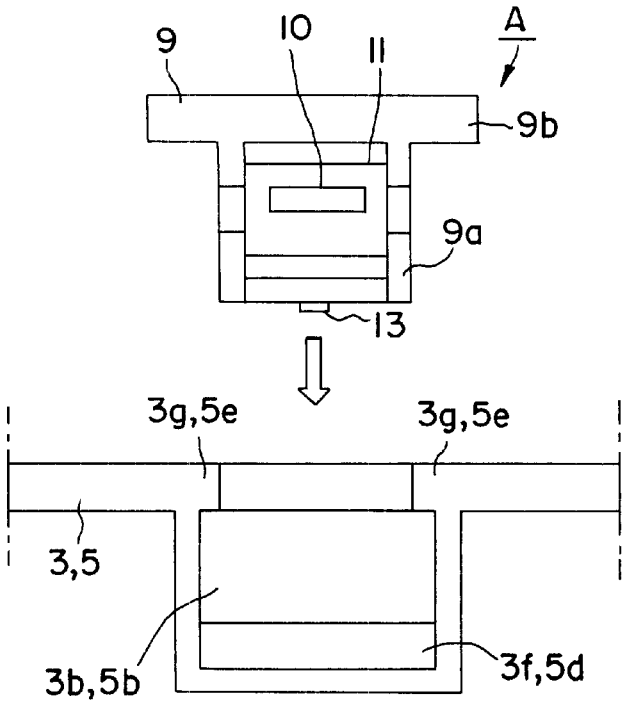
FIG. 12 (*a*) is a cross-sectional view showing a state in which a key hole insertion is being inserted in a key hole of the manhole cover according to the second embodiment of the key hole insertion for the manhole cover of the invention and a locking apparatus of the manhole cover utilizing the key hole insertion of the invention.
Figure 12B:
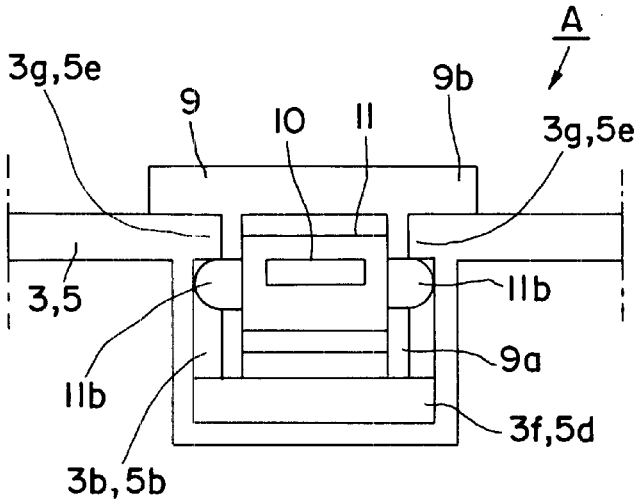

Referring to FIG. 12, the second embodiment of a key hole insertion for manhole cover according to the invention and a locking apparatus for manhole cover utilizing the key hole insertion are described as follows. FIG. 12 (*a*) is a cross-sectional view showing a state in which a key hole insertion is inserted in a key hole of the manhole cover according to the second embodiment of the key hole insertion for the manhole cover of the invention and the locking apparatus of the manhole cover utilizing the key hole insertion of the invention, and FIG. 12 (*b*) is a cross-sectional view showing a state in which the key hole insertion is inserted and locked in the key hole of the manhole cover according to the second embodiment. As for the portions to be structured in the same way as those of the first embodiment, the explanation is omitted by using the identical reference numbers.

In the first embodiment as shown in FIG. 5, the cap holding member 12 is fixed to the outer peripheral surface portion of the key hole 3*b* of the inner manhole cover 3 or the key hole 5*b* of the manhole cover 5. On the other hand, in this embodiment, the cap holding member 12 is omitted and it is so structured that a key hole insertion A is directly fitted to a key hole 3*b* of a manhole inner cover 3 or a key hole 5*b* of a manhole cover 5.

Referring to FIG. 12(*a*), 12(*b*), a projecting portion 3*g* or a projecting portion 5*e* is formed on a surface portion of the key hole 3*b* of the inner manhole cover 3 or the key hole 5*b* of the manhole cover 5 as an engaging portion projecting radially inward of the key hole 3*b* or the key hole 5*b*. An inserting portion 9*a* of a locking portion cap 9 is inserted through the projecting portion 3*g* or the projection portion 5*e* into the key hole 3*b* or the key hole 5*b*, and then a brim portion 9*b* of the locking portion cap 9 is in contact with the surface of the inner manhole cover 3 or the manhole cover 5 for making the key hole insertion A attached.

It is so structured that each pin 11*b* of a locking unit 11 is projecting radially outward to the inserting portion 9*a* to contact and engage with a back side of the projecting portion 3*g* or the projecting portion 5*e*, thereby locking the key hole insertion A to the key hole 3*b* of the manhole inner cover 3 or the key hole 5*b* of the manhole cover 5. Other structures are identically organized to those of the first embodiment.

According to the structure above, after insertion of the inserting portion 9*a* of the locking cap 9 into the key hole 3*b* of the inner manhole cover 3 or the key hole 5*b* of the manhole cover 5, the CPU 10*a* controls, upon receiving a detecting signal of the microswitch 13, a solenoid driver 10*d* for turning off an electromagnetic solenoid 11*a*, and then, each pin 11*b* of the locking unit 11 formed in the inserting portion 9*a* of the locking portion cap 9 is contacted and engaged with the back side of the projecting portion 3*g* or 5*e* projecting radially inward of the key hole 3*b* or the key hole 5*b*, thereby locking a manhole cover, and therefore an external access to the key hole 3*b* or the key hole 5*b* can be rejected.

Also, only when the control chip 10 permits opening or closing the locking apparatus upon receiving the unlock signal where an unlock signal is transmitted from the outside to the control chip 10, the locking unit 11 retracts the pin 11 b to release the engagement with the projecting portion 3*g* or 5*e*, thereby pulling the key hole insertion A out of the key hole 3*b* or the key hole 5*b*, and therefore only an authorized person or group can access to the key hole 3*b* of the inner manhole cover 3 or the key hole 5*b* of the manhole cover 5 and easily unlock the manhole cover.

A structure easily attaching the key hole insertion A can be obtained by only forming either projecting portion 3*g* or projecting portion 5*e* projecting radially inward of the key hole 3*b* or the key hole 5*b* on an upper part of the key hole 3*b* or the key hole 5*b* of a conventionally used, preexisting inner manhole cover 3 or manhole cover 5, so that it is economically preferred because no major design change is required.

Other structures are identically organized to those of the first embodiment, so the substantially same effect can be obtained.

Figure 13A:
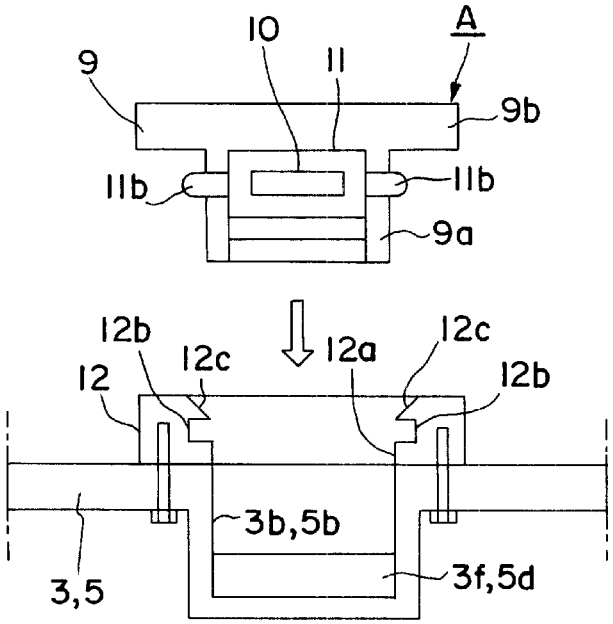
FIG. 13 (*a*) is a cross-sectional view showing a state in which a key hole insertion is being inserted in a cap holding member mounted at an outer peripheral surface portion of a key hole of the manhole cover according to the third embodiment of the key hole insertion for the manhole cover of the invention and the locking apparatus of the manhole cover utilizing the key hole insertion of the invention.
Figure 13B:
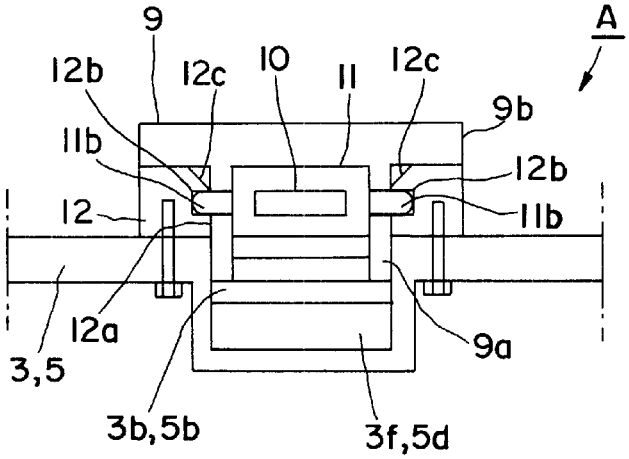
Figure 14A:
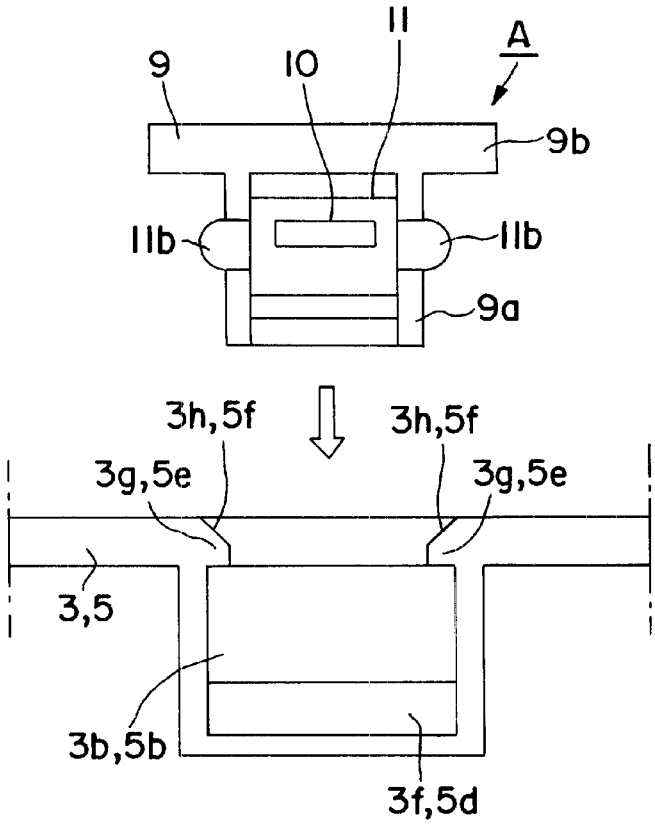
FIG. 14 (*a*) is a cross-sectional view showing a state in which a key hole insertion is being inserted in a key hole of the manhole cover according to the forth embodiment of the key hole insertion for the manhole cover of the invention and the locking apparatus of the manhole cover utilizing the key hole insertion of the invention.
Figure 14B:
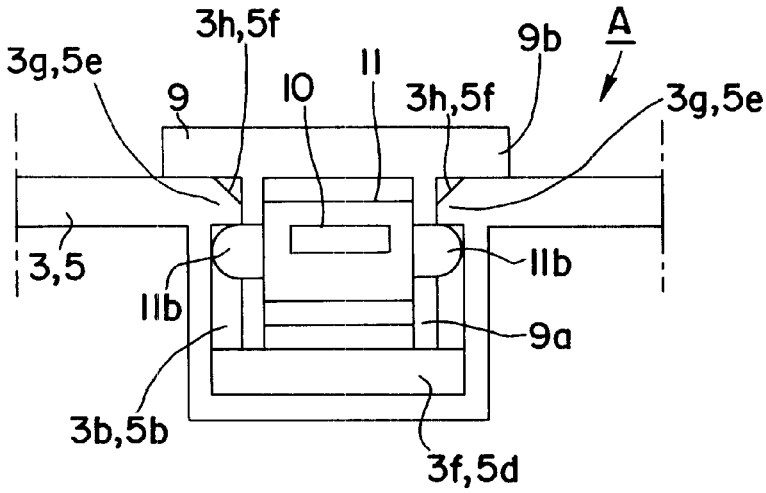

Referring to FIG. 13 and FIG. 14, the following is the description of the third and fourth embodiments of a manhole key hole insertion and a manhole cover locking apparatus with the key hole insertion according to the present invention. FIG. 13 (*a*) is a cross-sectional view showing a state in which a key hole insertion is being inserted in a cap holding member mounted at an outer peripheral surface portion of a key hole of the manhole cover according to the third embodiment of the key hole insertion for the manhole cover of the invention and the locking apparatus of the manhole cover utilizing the key hole insertion of the invention; FIG. 13 (*b*) is a cross-sectional view showing a state in which the key hole insertion is inserted and locked in the cap holding member mounted at the outer peripheral surface portion of the key hole of the manhole cover according to the third embodiment; FIG. 14 (*a*) is a cross-sectional view showing a state in which a key hole insertion is being inserted in a key hole of the manhole cover according to the forth embodiment of the key hole insertion for the manhole cover of the invention and the locking apparatus of the manhole cover utilizing the key hole insertion of the invention; FIG. 14 (*b*) is a cross-sectional view showing a state in which the key hole insertion is inserted and locked in the key hole of the manhole cover according to the fourth embodiment. The descriptions of the structure same as those in the first and second embodiments are omitted by using the identical reference numerals.

In the both third and fourth embodiments shown in FIGS. 13 (*a*), (*b*) and FIGS. 14(*a*), (*b*), respectively, the pin 11*b* of the locking unit 11 is normally biased by an elastic member, for example, a spring, not shown, toward the direction to which the pin 11*b* is projecting.

In the third embodiment shown in FIG. 13 (*a*), and FIG. 13(*b*) a tapered surface 12*c* is formed to pull the pin 11*b* inward in opposition to an urging force biased by the elastic member in slidably contacting to the pin 11*b* normally urged in a projecting direction at the surface portion of the through hole 12*a* of the cap holding member 12 of the first embodiment as shown in FIGS. 5 (*a*), (*b*).

When the inserting portion 9*a* of the locking cap 9 is inserted into the through hole 12*a* of the cap holding member 12, the pin 11*b* is slidably fitted on and thereafter pulled into the tapered surface 12*c* formed at an upper portion of the through hole 12*a* in opposition to an urging force biased by the elastic member. When the pin 11*b* reaches a position of the engaging opening 12*b* of the cap holding member 12, the pin 11*b* is projected by the force of the elastic member to engage with the engaging opening 12*b*, and therefore, the locking cap 9 is locked with respect to the key hole 3*b* of the inner manhole cover 3 or the key hole 5*b* of the manhole cover 5.

In the forth embodiment shown in FIGS. 14 (*a*), (*b*), a tapered surface 3*h,* 5*f* is formed to pull the pin 11*b* inward in opposition to an urging force biased by the elastic member in slidably contacting to the pin 11*b* normally urged in a projecting direction at the surface of the key hole 3*b* of the inner manhole cover 3 or the key hole 5*b* of the manhole cover 5 of the second embodiment shown in FIGS. 12 (*a*), 12(*b*).

When the insertion portion 9*a* of the locking cap 9 is inserted into the key hole 3*b* of the inner manhole cover 3 or the key hole 5*b* or the manhole cover 5, the pin 11*b* is slidably fitted on and thereafter pulled into the tapered surface 3*h* or 5*f* formed at the upper portion of the key hole 3*b* or key hole 5*b* in opposition to an urging force biased by the elastic member. When the pin 11*b* reaches a position passing over a projecting portion 3*g* or 5*e* formed at an upper portion of the key hole 3*b* or the key hole 5*b,* the pin 11*b* is in contact with and fittingly engaged with a back surface of the projecting portion 3*g,* 5*e* by the force of the elastic member, and therefore, the locking cap 9 is locked to the key hole 3*b* of the inner manhole cover 3 or the key hole 5*b* of the manhole cover 5.

According to the structures above, the pin 11*b,* normally urged to the outwardly projecting direction, is pulled inside in slidable contact with the tapered surface 12*c,* 3*h* or 5*f,* and since the pin 11*b* projects at the position where the pin 11*b* reaches the engaging opening 12*b* or the position passing the projecting portion 3*g* or 5*e,* the pin 11*b* engages with the engaging opening 12*b,* the projecting portion 3*g* or 5*e* in mechanical association with movement that the key hole insertion A is attached to the key hole 3*b* of the inner manhole cover 3 or the key hole 5*b* of the manhole cover 5. Therefore, required is to drive the electromagnetic solenoid 11*a* only during pulling the pin 11*b* inward, so that the micro-switch 13 needed in the first and second embodiments is no more required, and also no power source is needed in a lock position, which provides simplification of controlling the pin 11*b*. Other structures are the same as those of the mentioned embodiments, and the substantially identical effects can be obtained.

Figure 15A:
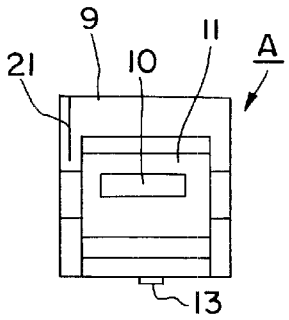
FIG. 15 (*a*) is a cross-sectional view showing a state in which a key hole insertion is being inserted in a key hole of the manhole cover according to the fifth embodiment of the key hole insertion for the manhole cover of the invention and the locking apparatus of the manhole cover utilizing the key hole insertion of the invention.
Figure 15A:
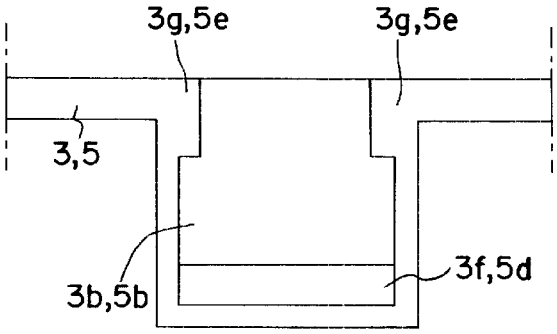
Figure 15B:
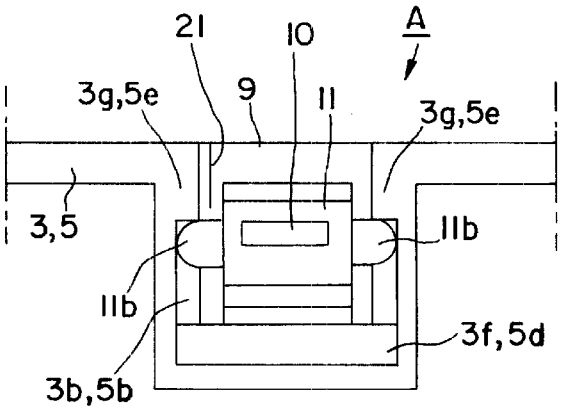
Figure 16:
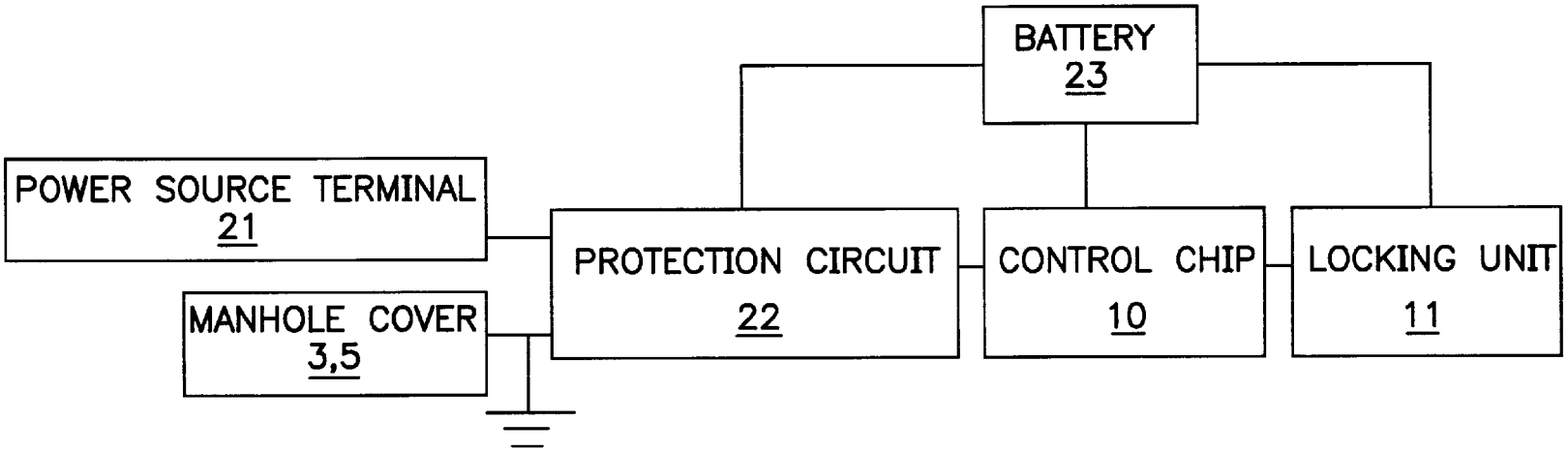
FIG. 16 is a block diagram showing an electric power source circuit according to the fifth embodiment.

Referring to FIG. 15 and FIG. 16, the following is the description of the fifth embodiment of a key hole insertion for a manhole cover and a manhole cover locking apparatus with the key hole insertion according to the present invention. FIG. 15 (*a*) is a cross-sectional view showing a state in which a key hole insertion is being inserted in a key hole of the manhole cover according to the fifth embodiment of the key hole insertion for the manhole cover of the invention and the locking apparatus of the manhole cover utilizing the key hole insertion of the invention; FIG. 15 (*b*) is a cross-sectional view showing a state in which the key hole insertion is inserted and locked in the key hole of the manhole cover according to the fifth embodiment; FIG. 16 is a block diagram showing an electric power source circuit according to the fifth embodiment. The description of the structure same as the mentioned embodiments is omitted by using the identical reference numbers.

Although in the second embodiment shown in FIG. 12, when the key hole insertion A is inserted in the key hole 3*b* of the inner manhole cover 3 or the key hole 5*b* of the manhole cover 5, the brim portion 9*b* of the key hole insertion A projects from the top surface of the inner manhole cover 3 or the manhole cover 5, the brim portion 9*b* is omitted in this embodiment shown in FIGS. 15(*a*), 15(*b*), and when the key hole insertion A is inserted into the key hole 3*b* of the inner manhole cover 3 or the key hole 5*b* of the manhole cover 5, the upper surface of the key hole insertion A and the upper surface of the inner manhole cover 3 or the manhole cover 5 is designed to be at substantially the same level. In addition, although in the above embodiments the power sources of the control chip 10 and the locking unit 11 are structured from storage in the batteries 10*f,* 11*c* transferred by the non-contact UL power source 14 using electromagnetic induction effects, the embodiment is structured to feed the electric power to the control chip 10 and the locking unit 11 by contacting electric power terminals to the apparatus from the outside as shown in FIG. 16.

As shown in FIGS. 15(*a*), 15(*b*), the key hole insertion A as a whole is designed to be fitted inside the key hole 3*b* of the inner manhole cover or the key hole 5*b* of the manhole cover 5, and therefore the height of the key hole insertion A is designed so that the top surface of the key hole insertion A and the top surface of the inner manhole cover 3 or the manhole cover 5 are at substantially the same level to each other when the key hole insertion A is put inside the key hole 3*b* of the inner manhole cover or the key hole 5*b* of the manhole cover 5.

The projection portions 3*g* or 5*g* are formed extending radially inward and serving as engaging portions at the surface of the key hole 3*b* of the inner manhole cover 3 or the key hole 5*b* of the manhole cover 5, and the key hole insertion A is attached by inserting the locking cap 9 into the key hole 3*b,* 5*b* in passing through the intervals among the projection portions 3*g,* 5*g*.

The pin 11*b* of the locking unit 11 projects radially outward over the key hole insertion A and is thereby engaged fittingly with the back surface of the projecting portion 3*g* or 5*e,* thus locking the key hole insertion A with respect to the key hole 3*b* of the inner manhole cover 3 or the key hole 5*b* of the manhole cover.

The power source terminal 21 connecting to the protection circuit 22 shown in FIG. 16 is built in the key hole insertion A in such a manner that a surface side portion of the key hole insertion A is exposed, and the inner manhole cover 3 or the manhole cover 5 is grounded.

The output side of the protection circuit 22 is connected to the control chip 10, the locking unit 11, and the battery 23 as a common capacitor or the like to which each of the control chip 10 and the locking unit 11 is connected respectively.

A power source terminal or the other external power terminal formed in the R/W terminal 18 is in electrical contact with the power source terminal 21 and the body of the inner manhole cover 3 or the body of the manhole cover 5, and the power can be given through the protection circuit 22 to the control chip 10, the locking unit 11 and the battery 23. After the power source terminal in the R/W terminal 18 is disconnected, the control chip 10 and the locking unit 11 can be operated by the power charged at the battery 23. Other structures are the same as those of the embodiments mentioned above, and the substantially identical effects can be obtained.

As for the method of providing the electric power to the control chip 10 and the locking unit 11, a power source connected to the control chip 10 and the locking unit 11 can be formed at the inner manhole cover 3, the outer manhole cover 4 or the manhole cover 5, and the electric power may be provided, through the electric cable as pulled into the manhole to which the manhole cover is attached, to be fed to the control chip 10 and the locking unit 11.

Figure 17A:
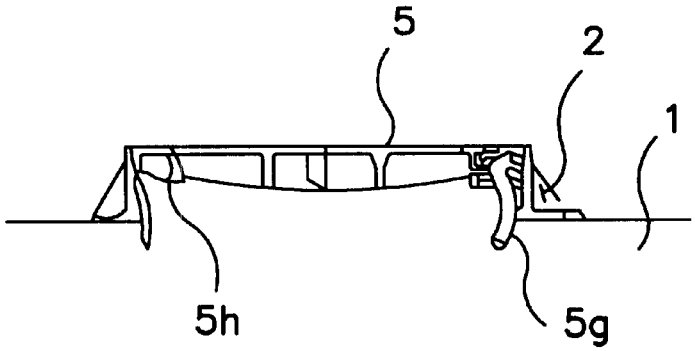
FIG. 17(a) PRIOR ART
FIG. 17 (*a*) is a cross-sectional view showing a structure of a rotary-opening type manhole cover.
Figure 17B:
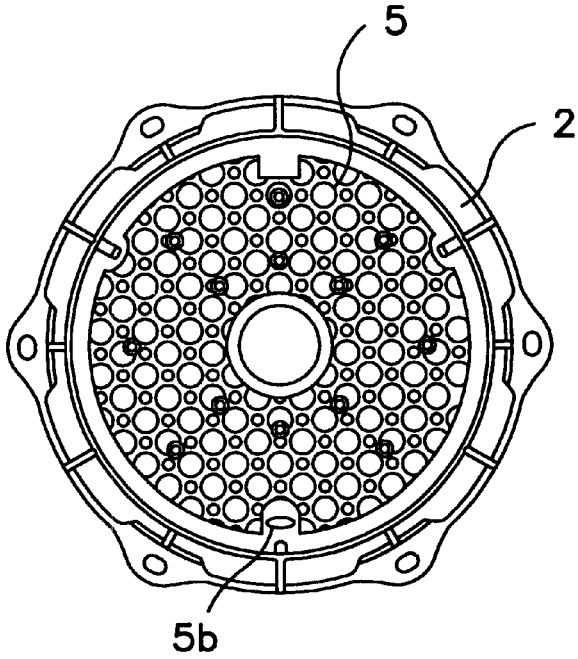
FIG. 17(b) PRIOR ART

Referring to FIGS. 17(*a*), 17(*b*), the following is the description of an example of the rotary-opening type manhole cover, to which the manhole key insertion and the manhole locking apparatus utilizing the key hole insertion according to the invention are applied. FIG. 17 (*a*) is a cross-sectional view showing a structure of a rotary-opening type manhole cover; FIG. 17 (*b*) is a plan view showing a structure of the rotary-opening type manhole cover. The explanation of the same structures as those of the previous embodiments is omitted by referring to the identical numerals.

Referring to FIGS. 17(*a*), 17(*b*), the manhole cover 5 is structured to be rotatable and openable with respect to the cover receiving frame 2 by pivotal movement in use of a hinge portion 5*g* placed at an outer round periphery of the manhole cover 5. An engagement piece 5*h* to be engaged with an engagement portion, not shown, of the cover receiving frame 2 is formed at an outer round periphery in opposition to the hinge portion 5*g* of the manhole cover 5.

In association with the closing movement of the manhole cover 5, the engagement piece 5*h* is engaged with the engaging portion, not shown, of the cover receiving frame 2, and thereafter locking is made by engaging the manhole cover 5. To open the manhole cover 5, an unlocking tool, not shown, is inserted into the key hole 5*b* formed in the manhole cover 5 at a position corresponding to the engagement piece 5*h*, and then the engagement piece 5 is escaped from an engagement portion, not shown, of the cover receiving frame 2 to release the engagement piece 5*h* of the manhole 5 from the engaging portion, not shown, and to unlock the cover.

Similarly as mentioned above, the key hole insertion A is inserted in the key hole 5*b* formed in the manhole cover 5 to enter in a locked state, and external accesses to the key hole 5*b* can be rejected. Other structures are the same as those of the mentioned embodiments, and the substantially identical effects can be obtained.

Referring to FIG. 18 through FIG. 21, an embodiment of the manhole cover opening-closing control system according to the invention is shown and described.

Figure 18:
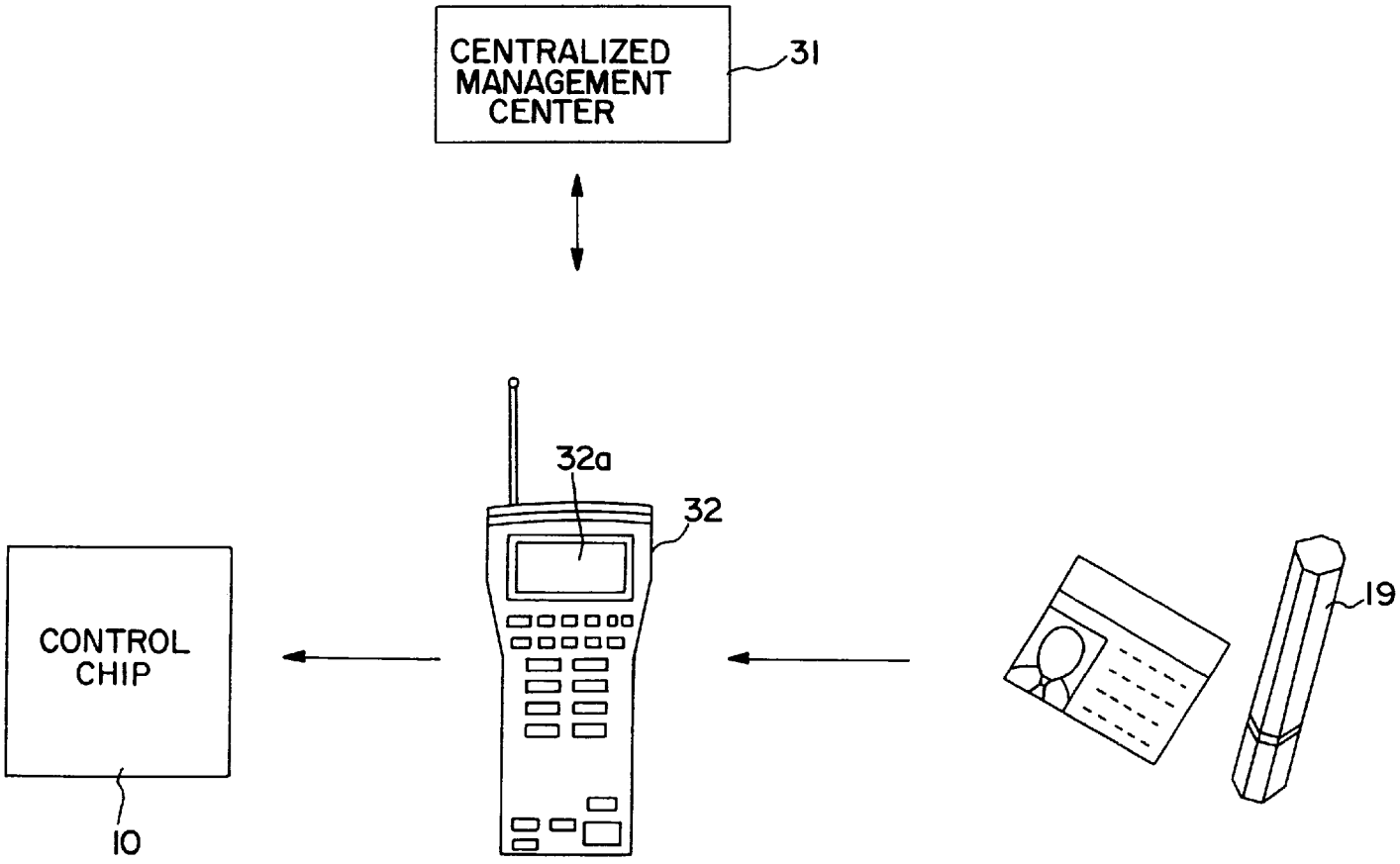
FIG. 18 is a view showing a state according to an opening and closing control system of the manhole cover of the invention, in which a personal authentication code is recognized by a personal identification mans and a non-contact or contact reading telecommunications terminal; and furthermore, after a placement code of the manhole cover is recognized by the non-contact or contact reading telecommunications terminal and a control chip inside a key hole insertion, communication is taken place between the non-contact or contact reading telecommunications terminal and a central controlling apparatus.

FIG. 18 is a view showing a state according to an opening and closing control system of the manhole cover of the invention, in which a personal authentication code is recognized by a personal identification mans and a non-contact or contact reading telecommunications terminal; and furthermore, after a placement code of the manhole cover is recognized by the non-contact or contact reading telecommunications terminal and a control chip inside a key hole insertion, communication is taken place between the non-contact or contact reading telecommunications terminal and a central controlling apparatus.

Figure 20A:
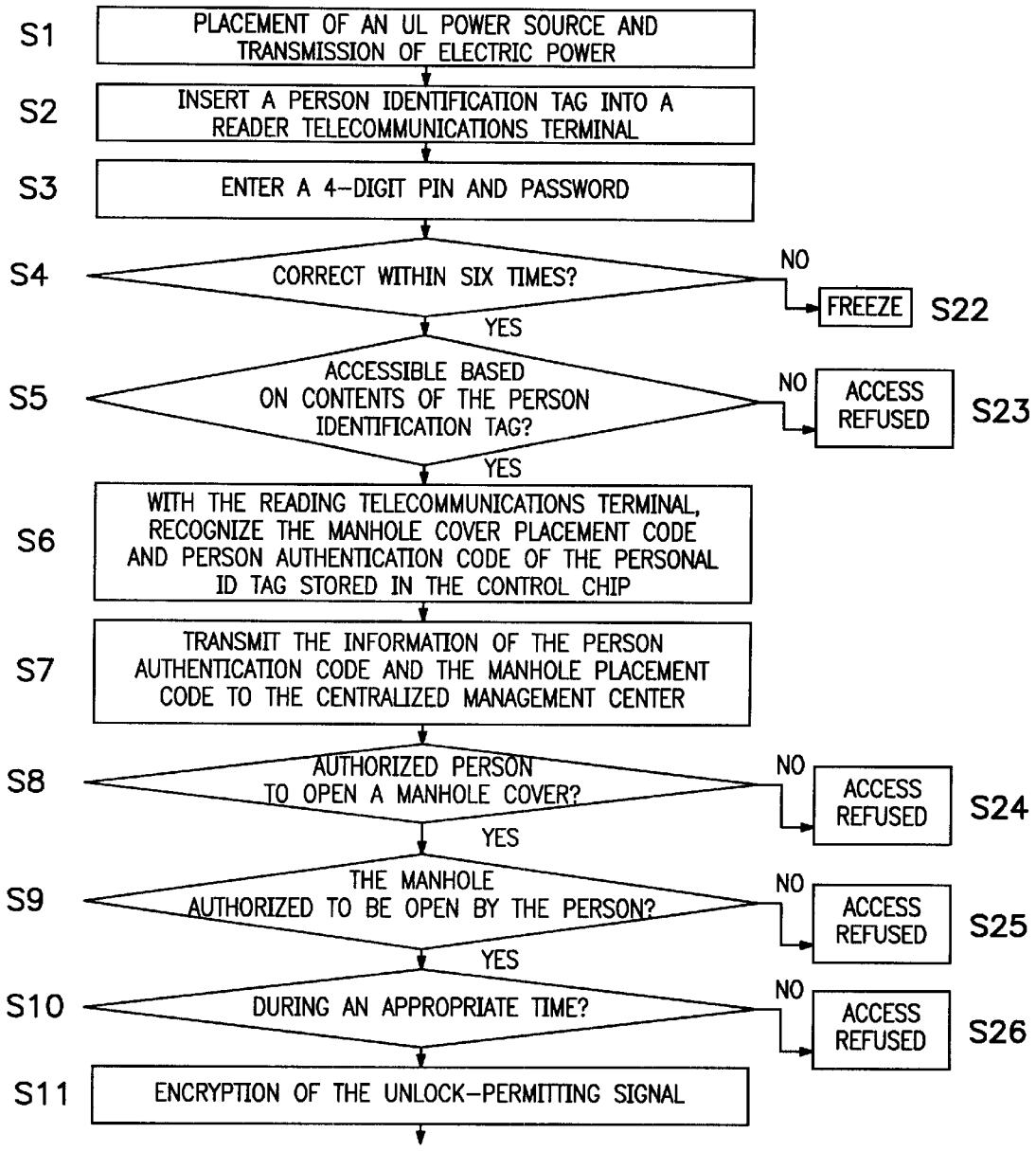
FIGS. 20(*a*) and 20(*b*) are flowcharts showing an opening and closing control for a manhole cover.
Figure 20B:
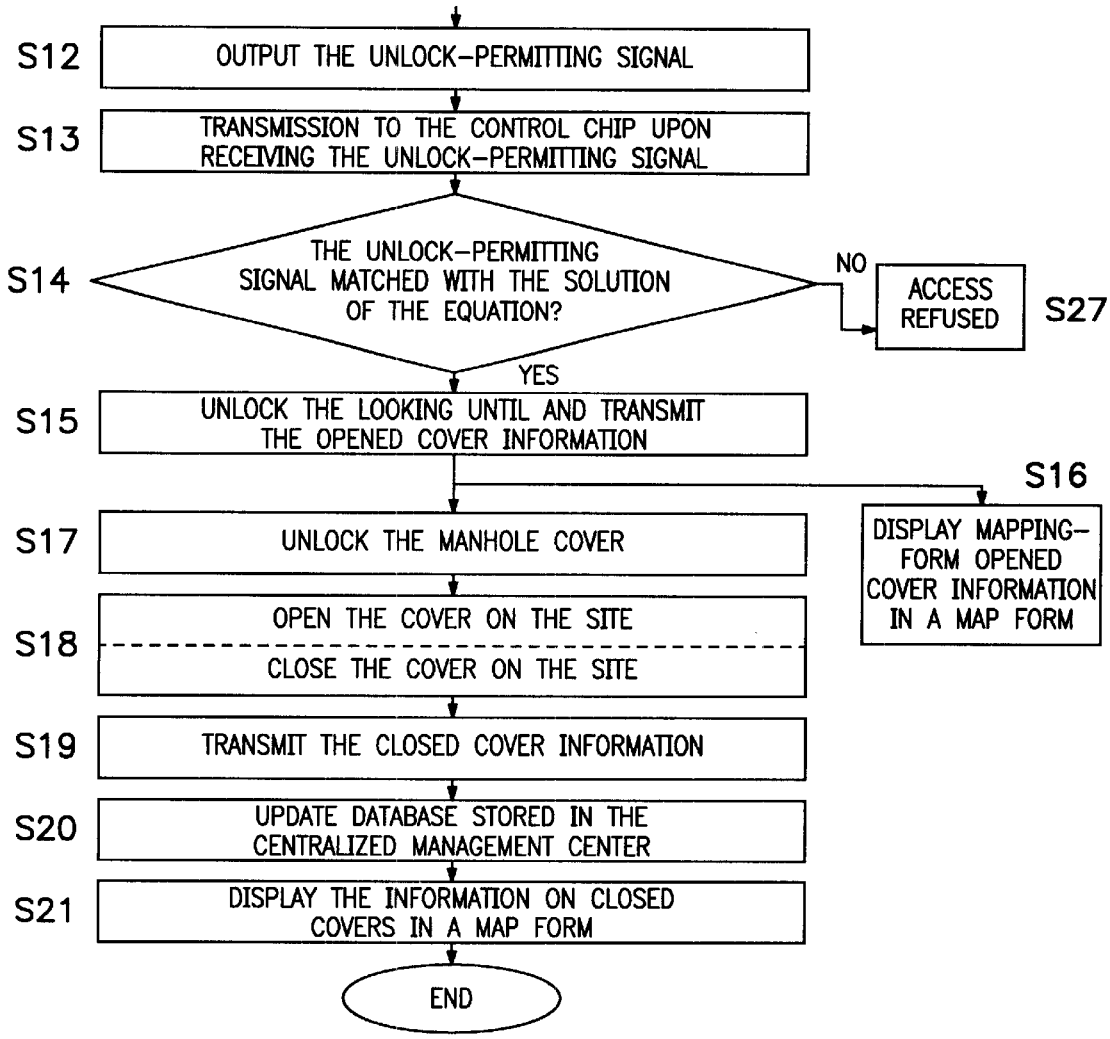
Figure 21:
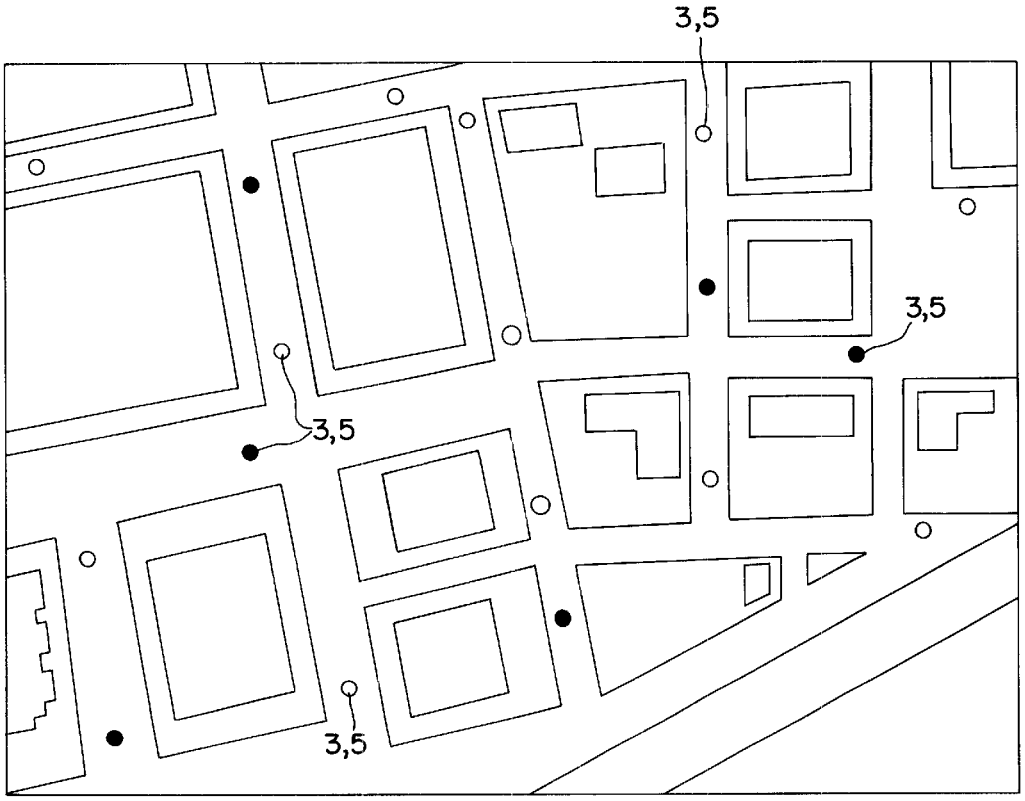
FIG. 21 is a view showing a state of mapping and monitoring opening cover status and closing cover status.
Figure 22A:
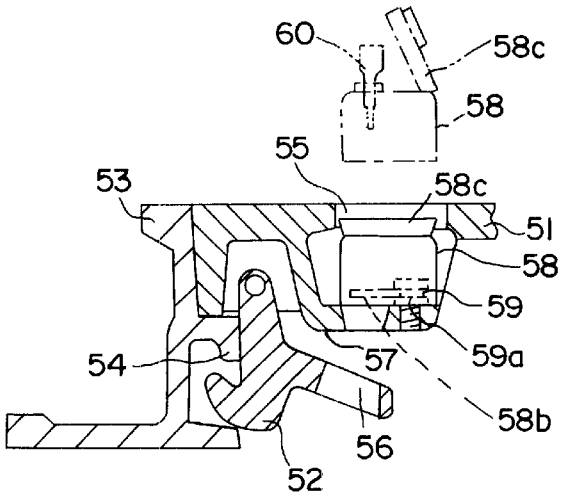
FIG. 22(a) PRIOR ART
FIG. 22 (*a*) is a view explaining an embodiment of prior art.
Figure 22B:
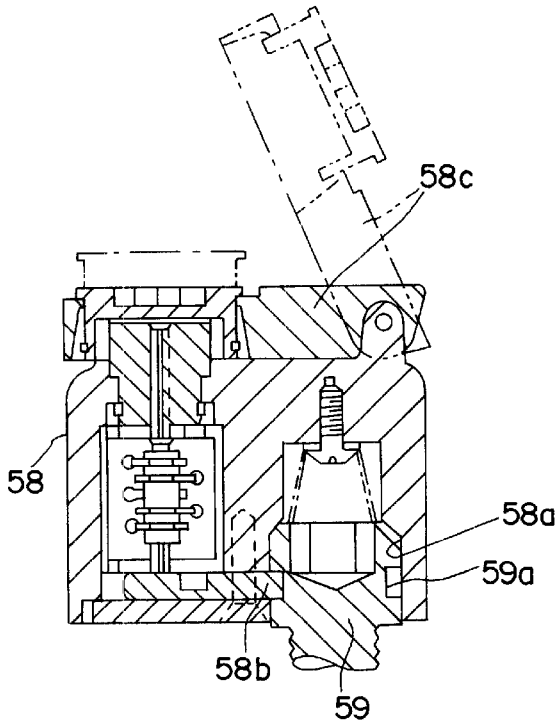
FIG. 22(b) PRIOR ART

FIG. 19 is a view showing an embodiment of a personal authentication code and a placement code of a manhole cover; FIGS. 20(*a*) and 20(*b*) flowcharts showing an opening and closing control for a manhole cover; FIG. 21 is a view showing a state of mapping and monitoring opening cover status and closing cover status.

According to the present embodiment, the CPU 10*a* shown in FIG. 6 and described above compares the personal authentication code α of the personal authentication tag carried by the authorized person or the group to open the inner manhole cover 3 or the manhole cover 5 with the information on the authentication code previously stored in the ROM 10*b*, and when both are identical, the CPU 10*a* provides the authentication and allows communications via the non-contact or contact telecommunications terminal 32 carried by the authorized person or group to open the inner manhole cover 3 or the manhole cover 5.

The CPU 10*a* is electrically connected to the transmitting-receiving terminal 10*e* for receiving an external unlocking signal as well as for transmitting the placement code β of the inner manhole cover 3 or the manhole cover 5 stored in the ROM 10 serving as the memory section, and to the battery 10*f* for receiving and storing the electric power from the outside.

The ROM 10*b* stores, though described below in detail, such as an operation program to make an inquiry to the unlock-permitting signal R sent from a centralized management center 31 and placement codes β of the inner manhole cover 3 or the manhole cover 5 to which the key hole insertion A is inserted. In addition, the ROM 10*b* also memorizes several messages on a display 32*a* serving as a display means for showing the authentication and identification results produced by the non-contact or contact reading terminal 32 as described above.

The RAM 10*c* suitably stores various data, for example, the unlock-permitting signal R sent from the centralized management center 31.

Every time that the key hole insertion A is at the unlocking manipulation, the battery 10*f*, as a power storage means, receives the electric power for the control chip 10 from the outside with or without contact, and then temporarily stores the electric power. The battery 11*c* as a power storage means receives power from the outside with or without a contact, and then temporarily stores the electric power to drive the electromagnetic solenoid 11*a*.

It is to be noted that the pin 11*b* of the locking unit 11 may be structured to project or retract by the motor rotation of the motor driver, not shown, controlled by the CPU 10*a*.

Drawings in the FIG. 18 to FIGS. 20(*a*) and 20(*b*) describe operations in which, using a non-contact or contact type reading telecommunications terminal 32 (hereinafter referred to as a reading telecommunications terminal) used for authenticating and identifying the authorized person or group for unlocking manipulations, the key hole insertion A is unlocked on a permission of unlocking the cover sent from the central controlling apparatus placed in the centralized management center 31.

The central control apparatus placed in the centralized management center 31 receives the personal authentication code α and the placement code β of inner manhole cover 3 or the manhole cover 5 as exemplified in FIG. 19 sent from the reading telecommunications terminal 32, makes authentication, comparison, and judgment of the data in accordance with the flowcharts shown in FIGS. 20(*a*) and 20(*b*), and allows unlocking the inner manhole cover 3 or the manhole cover 5.

The central controlling apparatus placed in the centralized management center 31 monitors the opening-closing status of the inner manhole cover 3 or the manhole cover 5 based on the opening manhole cover information and closing manhole cover information sent from the reading telecommunications terminal 32, for example, displaying in a mapping form as shown in FIG. 21.

After receiving the unlock-permitting signal R from the central control apparatus placed in the centralized management center 31, the reading telecommunications terminal 32 transmits the unlock-permitting signal to the control chip 10; inside the chip 10, the unlock-permitting signal R is compared. Then, the control chip 10 sends the control signal by which the locking unit 11 mounted in the key hole insertion A is controlled to unlock the key hole insertion A from the key hole 3*b* of the inner manhole cover 3 or the key hole 5*b* of the manhole cover 5.

The central controlling apparatus in the centralized management center 31 has a memory section storing the management data such as various plumbing or wiring diagrams with information about roads, those management incidental facilities or property occupying roads, and prescribed information stored in the central controlling apparatus in the centralized management center 31 can be inquired via the reading telecommunications terminal 32 at a stage that the central controlling apparatus of the centralized management center 31 permits opening of the inner manhole cover 3 or the manhole cover 5.

When unlocking the inner manhole cover 3 or the manhole cover 5, a person or operator of the group authorized to unlock the cover carries the reading telecommunications terminal 32, the personal authentication tag 19 and the UL power source 14 or the like as shown in FIG. 18 and come closer to the targeted inner manhole cover 3 or manhole cover 5.

In the memory section of the center controlling apparatus in the centralized management center 31, schedule information is memorized in which such matters, what date, which time zone, operators of who would work which inner manhole cover 3 or manhole cover 5 are registered in advance.

Where the key hole insertion A is in a locked state, for example, as shown in FIG. 5(*b*), the key hole insertion A is attached to the cap holding member 12 affixed to the outer peripheral surface of the key hole 3*b* of the inner manhole cover 3 or the key hole 5*b* of the manhole cover 5, and the pin 11*b* engages with the engaging opening 12*b* of the cap holding member 12 as projecting into the engaging opening 12*b* for locking.

The operator first places the UL power source 14 described above and shown in FIG. 7 and FIG. 8 on the key hole insertion A fitted in the inner manhole cover 3, or the manhole cover 5, and then presses the power transmission button 14*b* for about ten seconds to transfer the electric power to the battery 10*f* of the control chip 10 and the battery 11*c* of the locking unit 11 from the UL power source 14. (step S1 in FIG. 20(*a*)) When the operator confirmed the light of the display lamp 17*a* to make sure enough power is accumulated, he releases the power transmission button 14*b*.

The person or group authorized to unlock the inner manhole cover 3 or the manhole cover 5 shown in FIG. 18 inserts the personal identification tag 19 including a personal authentication code a into a tag slot, not shown, of the reader telecommunications terminal 32 (step S2 in FIG. 20(*a*)), and enters the four-digit personal identification number and password are entered (step S3 in FIG. 20(*a*)). The password or the like can be formed with any key entry other than the four digits.

At that time, the reading telecommunications terminal 32 admits to input wrong personal identification number and wrong password within six times respectively, but when the errors occur six times in row, the display 32*a* serving as the display means of the reading telecommunications terminal 32 shows a message such as "Access Refused" or the like, and also the personal authentication tag 19 itself is frozen (step S22 in FIG. 20(*a*)), which is unavailable until it is reset at the tag publishing center which issues and manages the personal authentication tag 19.

At step S4 in FIG. 20(*a*), when each of the personal identification number and the password coincides respectively within six times, the reading telecommunications terminal 32 confirms the personal identification number and the password and then shows on display 32*a* messages "Personal identification number confirmed" and "Password confirmed," respectively. At step S5 in FIG. 20(*a*), a judgement is made based on the authentication and identification contents read from the personal authentication tag 19 as to whether to permit an access for the recognition of the manhole cover placement code α of the inner manhole cover 3 or the manhole cover 5 stored in the memory section or the ROM 10*b* in the control chip 10 of the key hole insertion A. It is to be noted that a permissive plural number other than six might suitably be utilized for entering the personal identification number and the password mentioned in the step S4 in FIG. 20(*a*).

According to the embodiment as shown in FIG. 19, the personal authentication code α is made up of a trader number of the trader authorized to access to the key hole 3*b* or 5*b* and a personal code number of the authorized person or group; those are arbitrary and unique identification numbers generated by a random assignment. The placement code β for the inner manhole cover 3 or the manhole cover 5 is made up of a section code number and a serial number which are arbitrary and unique identification number generated by random assignment; the section code number is defined as the number showing an area or section of each resting inner manhole cover 3 or the manhole cover 5 among the plural manholes in a predetermined area or district; the serial number is the number showing the particular section of the inner manhole cover 3 or the manhole cover 5.

According to the step S5 in FIG. 20(*a*), when the access to the control chip 10 of the key hole insertion A is not authorized by judgment, the access is refused (step S23 in FIG. 20(*a*), and then the message "Access Refused" or the like is on the display 32*a* of the reading telecommunications terminal 32.

At the step S5 shown in the FIG. 20(*a*), at a stage in which the access to the control chip 10 mounted in the key hole insertion A is judged, the personal authentication code α of the personal identification tag 19 is temporarily memorized in the RAM 10*c* of the control chip 10. At the step S6 in FIG. 20(*a*), the operator reads, via using the reading telecommunications terminal 32, the placement code β of the inner manhole cover 3 or the manhole cover 5 stored in the ROM 10*b* of the control chip 10 in the key hole insertion A, and thereafter transmits the manhole placement code β and the personal authentication code α read by the personal identification tag 19 to the centralized management center 31 (step S7 in FIG. 20(*a*)).

According to steps S8, S9 and S10, the central controlling apparatus in the centralized management center 31 receives both the personal authentication code α and the placement code β sent from the reading telecommunications terminal 32, and the central controlling apparatus judges based on the schedule information previously registered based on information of the personal authentication code α and the placement code β as to whether the operator is an authorized person to open or not (step S8 in FIG. 20(*a*)), whether the cover is the inner manhole cover 3 or the manhole cover 5 authorized to be open by the person or not (step S9 in FIG. 20(*a*)), and whether the transmitting date and time zone is authorized date and time zone or not (step 10 in FIG. 20(*a*)). When each condition of those steps is not satisfied, the access is respectively refused (step S24, S25 or S26 in FIG. 20(*a*)), thus sending a signal for refused access to the reading telecommunications terminal 32 that in turn shows a message "Access Refused" or the like on the display 32*a*.

According to the steps S8, S9, and S10, when each of those conditions mentioned is satisfied, the central controlling apparatus in the centralized management center 31 sends an unlock-permitting signal R for opening the inner manhole cover 3 or the manhole cover 5 to the reading telecommunications terminal 32, and in the present embodiment, the unlock-permitting signal R is sent in the form of encryption (step S11 and S 12 in FIG. 20(*b*)).

As for the encryption of the unlock-permitting signal mentioned above, a method for solving the complicated equation to some extent is used; for example, an unlock-permitting signal R is given by an circular equation by assigning the personal authentication code α and the placement code β as follows:

[Equation 1]

$$\alpha^2+\beta^2=R^2 \quad (1)$$

For example, where the personal authentication code α is "4506289" and the placement code β is "0471960" as shown in FIG. 19, the unlock-permitting signal R is generated as "4530936" given by the circular equation as shown in Equation (1) to be transmitted.

Besides the circular equation shown as the equation (1), other arithmetical calculations or the like, for example, an ellipse equation, or an angle of inclination of tangent line to the points on the ellipse given by an ellipse equation in assigning values α and β, may be used to generate an encryption of the unlock-permitting signal R so as to be not readily interpreted for transmission from the centralized management center 31.

After receiving the unlock-permitting signal R sent from the centralized management center 31, the reading telecommunications terminal 32 sends the unlock-permitting signal R to the control chip 10 (step S13 in FIG. 20(*b*)). Inside the control chip 10, the CPU 10*a* calculates a solution R' using the above-mentioned circular equation (1) stored in the ROM 10*b,* using the value of the personal authentication code α temporarily stored in the RAM 10*c* and value of the placement code β memorized in the ROM 10*b* according to the step S5 in FIG. 20(*a*). The CPU 10*a* thereafter judges whether or not the solution R' coincides with the unlock-permitting signal R sent from the centralized management center 31 via the reading telecommunications terminal 32 (step S14 in FIG. 20(*b*)).

According to the step S14 in FIG. 20(*b*), when the unlock-permitting signal R and the solution R' coincides with each other, a signal admitting the access to the key hole 3*b* or the key hole 5*b* is sent to the reading telecommunications terminal 32 which in turn shows "Access Authorized" on the display 32*a*.

At step S14 in FIG. 20(*b*), the operator, when authorized to access to the key hole 3*b* or the key hole 5*b,* can have two choices with an operational button or buttons on the reading telecommunications terminal 32: opening the inner manhole cover 3 or the manhole cover 5, or without commanding the opening of the manhole cover 3 or the manhole cover 5, only inquiring about a variety of information stored in the memory section of the central controlling apparatus in the centralized management center 31 about management data such as various plumbing or wiring diagrams with information about roads, those management incidental facilities or property occupying roads.

According to step S14 in FIG. 20(*b*), when the operator controls the operational button or buttons on the treading telecommunications terminal 32 to execute a command for the opening of the inner manhole cover 3 or the manhole cover 5, the reading telecommunications terminal 32 transmits an unlock command to the control chip 10 in the form of the unlocking signal, and at the same time the opening manhole cover signal is sent to the centralized management center 31 (step S15 in FIG. 20(*b*)).

At this moment, the central controlling apparatus in the centralized management center 31 monitors the opening -closing status of the inner manhole cover 3 or the manhole cover 5 based on the opened cover information sent from the reading telecommunications terminal 32 and then displays the status in a mapping form as shown in FIG. 21 (step S16 in FIG. 20(*b*)). According to FIG. 21, a black circle designates the inner manhole cover 3 and the manhole cover 5 in an open state, and a white circle designates the inner manhole cover 3 and the manhole cover 5 in a closed state.

The control chip 10, after receiving the unlock signal from the reading telecommunications terminal 32 via the transmitting-receiving device 10*e,* controls the solenoid driver 11*d,* and then, utilizing the power charged in the battery 11*c,* the electromagnetic solenoid 11*a* is turned on to pull the pins 11*b* inward, thereby unlocking the locking unit 11 (step S17 in FIG. 20(*b*)).

According to the step S14 in FIG. 20(*b*), when the unlock-permitting signal R does not coincide with the solution R' given by the arithmetical circular equation computed in the control chip 10, the access to the key hole 3*b* or the key hole 5*b* is refused (step S27 in FIG. 20(*b*)).

With respect to step S15 in FIG. 20(*b*) mentioned above, because an unlocking time is set for ten seconds during which the electromagnetic solenoid 11*a* is pulling the pins 11*b* inward for unlocking the lock of the locking unit 11. If the key hole insertion A is not pulled out of the key hole 3*b* or the key hole 5*b* within ten seconds, the CPU 10*a* starts controlling the solenoid driver 10*d* to turn off the electromagnetic solenoid 11*a*. As a result, the pins 11*b* are protruding again enough to engage with the engaging openings 12*b* of the cap holding member 12, thereby locking the key hole insertion A with respect to the key hole 3*b* or the key hole 5*b*.

According to the step S18 in FIG. 20(*b*), to place the key hole insertion A into the locked position with respect to the key hole 3*b* or the key hole 5*b* after opening of the inner manhole cover 3 and the manhole cover 5 and completing the prescribed work, the key hole insertion A is downwardly inserted into the key hole 3*b* of the inner manhole cover 3 or the key hole 5*b* of the manhole cover 5, and consequently, an actuator of the micro-switch 13 mounted on the tip of the key hole insertion A contacts to the surface of the lock 3*f* and 5*d,* thereby turning on the micro-switch 13. Following this detecting information, the CPU 10*a* controls the solenoid driver 10*d* to turn off the electromagnetic solenoid 11*a* of the locking unit 11, rendering the pins 11*b* to engage with the engaging openings 12*b* of the cap holding member 12, and thereby locking the key hole insertion A to the key hole 3*b* or the key hole 5*b*.

It is to be noted that for the driving power means for the locking unit 11, the electric power temporarily charged at the previous time in the battery 11*c* is used in a previously described manner. This locking operation does not require the reading telecommunications terminal 32 and the personal authentication tag 19.

At the stage that the key hole insertion A has been locked with respect to the key hole 3*b* or the key hole 5*b,* the operator transmits a manhole closing information signal to the centralized management center 31 via the reading telecommunications terminal 32 (step S19 in FIG. 20(*b*)), and he also sends the information signal concerning the construction or the operation, thereby updating the database information stored in the centralized management center 31 (step S20 in FIG. 20(*b*)).

Based on the closing manhole cover information sent from the reading telecommunications terminal 32, the central controlling apparatus in the centralized management center 31 monitors the opening and closing status of the inner manhole cover 3 or the manhole cover 5 and shows the status in a mapping form as shown in FIG. 21 (step S21 in FIG. 20(*b*)).

Referring to the step S14 in FIG. 20(*b*), when the operator, at a stage that an access permission for the key hole 3, 5 is determined, controls the operation button or buttons on the reading telecommunications terminal 32 to execute instructions for referring the variety of information stored in the memory section of the central controlling apparatus in the centralized management center 31 about management data such as various plumbing or wiring diagrams with information about roads, those management incidental facilities or property occupying roads or the like, the reading telecommunications terminal 31 transmits the inquiry command in the form of inquiry-demanding signal to the centralized management center 31.

The central controlling apparatus in the centralized management center 31, receiving the inquiry-demanding signal from the reading telecommunications terminal 32, sends back to the reading telecommunications terminal 32 the inquired information retrieved from the previously stored information in the memory section such management data as various plumbing or wiring diagrams with information about roads, those management incidental facilities or property occupying roads or the like, and the retrieved information is shown on the display 32*a* of the reading telecommunications terminal 32.

In the previous embodiment described an example using the non-contact reading telecommunications terminal 32, but it is also possible to use a contact reading telecommunications terminal in which information or electric power is received and sent via an electric cable or the like connecting to the connecting terminal formed at the key hole insertion A.

According to the above structure, after the non-contact or contact reading telecommunications terminal 32 recognizes the personal authentication code $\alpha$ of the personal identification tag 19 and the manhole placement code $\beta$ of the inner manhole cover 3 or the manhole cover 5 memorized in the memory section or the ROM 10*b* of the control chip 10 mounted in the key hole insertion A, the non-contact or contact reading telecommunications terminal 32 transmits the personal authentication code $\alpha$ of the personal identification tag 19 and the manhole placement code $\beta$ to the central controlling apparatus in the centralized management center 31. The central controlling apparatus, after effecting the identification of the personal authentication (ID) and of the authentication of the manhole to be opened (ID), sends the unlock-permitting signal R to the non-contact or contact reading telecommunications terminal 32 that in turn transmits it to the control chip 10, and the control chip 10 makes an inquiry about the unlock-permitting signal R inside and sends the control signal by which the locking unit 11 mounted in the key hole insertion A is controlled to unlock the key hole insertion A with respect to the key hole 3*b* of the inner manhole cover 3 or the key hole 5*b* of the manhole cover 5. Thus, the locking process is securely and severely made, and the only authorized person or group can easily unlock the manhole cover.

Since the permission of the unlocking the key hole insertion A is instructed by the central controlling apparatus of the centralized management center 31, the locking or unlocking status of the inner manhole cover 3 or the manhole cover 5 can be integrally managed, and thus sound security of the manhole inside facilities can be achieved.

In the case where the central controlling apparatus in the centralized management center 31 monitors the opening or closing status of the inner manhole cover 3 or the manhole cover 5 based on the opening cover or closing cover information sent from the non-contact or contact reading terminals 32, a series of the present status of the construction work can be obtained by monitoring the opening or closing cover information for plural inner manhole covers 3 and the manhole covers 5, and such information is also available to the traffic information by making it in a mapping form.

When it is constructed in such a way that the non-contact or contact reading telecommunications terminal 32 can inquire about the prescribed information stored in the central controlling apparatus in the centralized management center 31 at a stage that the opening the inner manhole cover 3 or the manhole cover 5 is authorized by the central controlling apparatus of the centralized management center 31, the only authorized person or group can inquire about the management data stored in the central controlling apparatus such as various plumbing or wiring diagrams with information about roads, those management incidental facilities or property occupying roads.

Entering a wrong personal identification number and a wrong password can be permitted within prescribed times, and if the true number or password is not entered within the prescribed times, unlocking process is not authorized. At the same time, such process allows the authorized person to make a mistake in entering a wrong number as long as it is within the prescribed times, thus improving the unlocking operation while blocking an external access outside by an unauthorized intruder to prevent such accidents as an information leakage or subversive activities beforehand.

Since the unlocking position of the key hole insertion A with respect to the key hole 3*b* or 5*b* controlled by the locking unit 11 goes automatically back to a locking position after passing predetermined time, the key hole insertion A is therefore automatically locked with respect to the key hole 3*b* or 5*b* after the predetermined time passed even if the operator left the site for some reason without locking the manhole, so that high security to the manhole management is provided.

According to the structure in which, the result of the authentication and identification made in the reading telecommunications terminal 32 can be shown on the display 32*a* of the reading telecommunications terminal 32, an operator can easily recognize whether an access is authorized or refused and he also can receive, if necessary, the reason for the access refusal.

The only person or group authorized to access the key hole 3, 5 can make an inquiry through reading telecommunications terminal 32 about information stored in the central controlling apparatus in the centralized management center 31 such management data as various plumbing or wiring diagrams with information about roads, those management incidental facilities or property occupying roads, and therefore, the only person or group authorized to access the key hole 3, 5 knows the above various information. Consequently, collecting information related to the construction become precise, prompt and easy as done on the work site, which also facilitates effectiveness of patrol, on-site examination, construction or on-site joint meeting done at work execution.

Since the control chip 10 and the locking unit 11 have their own power storage means, batteries 10*f* and 11*c*, for receiving electric charge from outside without a contact and for storing electric charge in the respective batteries, those batteries 10*f* and 11*c* can ensure power for operating the control chip 10 and the locking unit 11 by feeding electric power in a contact or non-contact manner from the outside during unlocking of the inner manhole cover 3 or the manhole cover 5.

In addition, a simple unlocking process is available with easy operation without imposing any uncomfortable posture.

According to the present embodiment, a different person or group authorized to access can be registered on different manholes (including handholes) respectively in the central controlling apparatus in the centralized management center 31.

That is, the apparatus can set in a manner in which a manhole x (or handhole x), for example, is only accessible by a group x and a manhole y (or handhole y) is only accessible by a group y, but a manhole z (or handhole z) is accessible by both group x and y.

Thus, one or more reading telecommunications terminals 32 allow access to the specific key hole insertions A in the manhole key hole 3*b* of the inner manhole cover 3 or the key hole 5*b* of the manhole cover 5 among key hole insertions A in plural key holes 3*b* or 5*b* of the inner manhole cover 3 or the manhole cover 5, so that the opening and closing control system for inner manhole cover 3 or manhole cover 5 can be so structured that the access to the specific key holes 3*b* of the inner manhole covers 3 or the key holes 5*b* of the manhole covers 5 performed by many authorized persons or groups can be integrally managed in the centralized management center 31 with the different operations such as different constructions, maintenances, inspections or meter reading using different conditions.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but defined claims set forth below.

What is claimed is:

1. A key hole insertion for a manhole cover comprising:

a locking cap detachably attached and capable of locking to a key hole formed in a cover body of the manhole cover for rejecting an access of a cover-opening handle key to the key hole from outside;

a control chip mounted in the locking cap for permitting unlocking of the locking cap from the key hole upon receiving an unlock signal transmitted from outside; and a locking unit formed in the locking cap for unlocking the locking cap from the key hole upon receiving a control signal from the control chip.

2. The key hole insertion according to claim 1, wherein the locking unit has a pin capable of extending radially outward from an inserting portion of the locking cap that is inserted in the key hole of the cover body and engaging with an engaging portion of the cover body.

3. The key hole insertion according to claim 1, wherein the unlock signal is transmitted from a non-contact reading and writing terminal which authenticates and identifies a person or a group who is authorized to unlock the key hole insertion.

4. A locking apparatus for the key hole insertion for a manhole cover of claim 1 comprising:

a cap holding member secured in an outer peripheral surface of the key hole insertion for the manhole cover; and a pin capable of extending radially outward from an inserting portion of the locking cap that is inserted in a through hole of the cap holding member toward the key hole of the cover body and engaging with an engaging portion placed radially to the through hole of the cap holding member.

5. A locking system for a manhole cover in which a key hole insertion has a locking cap detachably attached and capable of locking to a key hole in a cover body of the manhole cover can reject an access of a cover-opening handle key to the key hole from outside, the locking system comprising:

a personal identification tag having a personal authentication code of a person or group who is authorized to unlock the manhole cover;

a non-contact reading and writing terminal used for sending an unlock signal after recognizing the personal authentication code in the personal identification tag and effecting authentication and identification of the person or group who is authorized to unlock the manhole cover;

a control chip mounted in the locking cap for receiving the unlock signal from the non-contact reading and writing terminal to permit unlock of the locking cap to the key hole; and a locking unit mounted in the locking cap for unlocking the lock of the locking cap from the key hole upon receiving a control signal sent from the control chip.

6. The manhole cover locking system according to claim 5, wherein the non-contact reading and writing terminal utilizes a personal identification number and/or a password for authentication and identification purpose.

7. The manhole cover locking system according to claim 5, wherein input errors of the personal identification number or the password can be admitted within prescribed times, and if the errors are made over the prescribed times, unlocking process is not authorized, while the use of the personal identification tag is frozen.

8. The manhole cover locking system according to claim 5, wherein the locking unit shifts the unlocked state of the key hole insertion with respect to the key hole back to a locking state after passing a prescribed time upon receiving a control signal from the control chip.

9. The manhole cover locking system according to claim 5, wherein the non-contact reading and writing outputs the result of the authentication and identification on a display means formed at the non-contact reading and writing terminal.

10. The manhole cover locking system according to claim 5, wherein the non-contact reading and writing terminal is capable of inquiring about certain information stored in the control chip after the authentication and identification is made by the non-contact reading and writing terminal.

11. The manhole cover locking system according to claim 5, wherein the control chip and the locking unit comprise a battery means for receiving external electric power with no contact from the outside and for storing the power.

12. An unlocking method for a manhole cover locking system in which the key hole insertion has a locking cap detachably_attached and capable of locking to a key hole in a cover body of the manhole cover can reject an access of a cover-opening handle key to the key hole from outside, wherein the manhole cover locking system comprises, a personal identification tag having a personal authentication code of a person or group who is authorized to unlock the manhole cover; a non-contact reading and writing terminal used for sending an unlock signal after recognizing the personal authentication code in the personal identification tag and effecting authentication and identification of the person or group who is authorized to unlock the manhole cover; a control chip mounted in the locking cap for receiving the unlock signal from the non-contact reading and writing terminal to permit unlocking of the locking cap to the key hole; and a locking unit mounted in the locking cap for unlocking the lock of the locking cap from the key hole upon receiving a control signal sent from the control chip, wherein, at the process where the non-contact reading and writing terminal effects the authentication and identification after recognizing the personal identification tag, the non-contact reading and writing terminal transmits the unlock signal to the control chip that in turn sends a control signal by which the locking unit unlocks the locking cap with respect to the key hole.

13. A manhole cover opening and closing control system in which a key hole insertion has a locking cap detachably attached and capable of locking to a key hole in a cover body and capable of rejecting an access of a cover-opening handle key to the key hole from outside, the system comprising:

a non-contact or contact reading telecommunications terminal which recognizes a personal authentication code of a person or group who is authorized to unlock the manhole cover, and also recognizes a placement code for manhole cover stored in a memory of a control chip mounted in the key hole insertion; and a central controlling apparatus admitting the opening of the manhole cover upon receiving a personal authentication code and the placement code transmitted from the non-contact or contact reading telecommunication terminal; and wherein the non-contact or contact reading telecommunications terminal, upon receiving an unlock permitting signal sent from the central controlling apparatus, transmits an unlock signal to the control chip, which in turn sends a control signal to the locking unit in the key hole insertion for controlling the locking unit to unlock the key hole insertion with respect to the key hole.

14. The manhole cover opening and closing control system according to claim 13, wherein the non-contact or contact reader telecommunications terminal, after receiving the unlock permitting signal from the central controlling apparatus, sends the unlock permitting command to the control chip, and the control chip compares the unlock permitting signal in the control chip and then sends a control signal to control the locking unit in the key hole insertion, thereby unlocking the key hole insertion with respect to the key hole.

15. The manhole cover opening and closing control system according to claim 13, wherein the central controlling apparatus monitors the opening and closing of the manhole cover status based on information transmitted from the non-contact or contact reading telecommunications terminal.

16. The manhole cover opening and closing system according to claim 13, wherein the non-contact or contact reading telecommunications terminal can inquire about prescribed information stored in the central controlling apparatus after the central controlling apparatus authorizes the opening of the manhole cover.

* * * * *